US006068161A

United States Patent [19]

Soehnlen et al.

[11] Patent Number: 6,068,161

[45] Date of Patent: May 30, 2000

[54] STACKABLE, THIN-WALLED CONTAINERS HAVING A STRUCTURAL LOAD DISTRIBUTING FEATURE PERMITTING CASELESS SHIPPING

[75] Inventors: Gregory M. Soehnlen, N. Canton; Dale Panasewicz, Strongsville; Lawrence A. Becks, N. Canton, all of Ohio

[73] Assignee: Creative Edge Design Group, Ltd., Canton, Ohio

[21] Appl. No.: 09/114,244

[22] Filed: Jun. 29, 1998

Related U.S. Application Data

[60] Provisional application No. 60/052,775, Jul. 1, 1997.

[51] Int. Cl.[7] ..... B67D 5/60

[52] U.S. Cl. ..... 222/143; 215/382; 222/571; 220/675

[58] Field of Search ..... 222/571, 481.5, 222/143; 215/382; 220/669, 675; 206/504

[56] References Cited

U.S. PATENT DOCUMENTS 1,746,332 2/1930 Barroll ..... 222/571

4,372,455 2/1983 Cochran ..... 215/382

4,979,628 12/1990 Robbins, III ..... 220/675

5,485,920 1/1996 Fritz ..... 206/504

*Primary Examiner*—Gregory L. Huson

*Attorney, Agent, or Firm*—Fay, Sharpe, Fagan, Minnich & McKee, LLP

[57] ABSTRACT

A liquid container for a comestible product such as milk or juice includes a base having a substantially planar region, a top surface having a substantially planar region parallel to the substantially planar region of the base and having a pour spout. A sidewall is integrally formed with and extends between the base and top surface, and includes a structural load distributing feature that transfers loads from the top surface to the base. A handle is interposed between the base and top surface and integrally formed with the base, top surface, and sidewall. The containers can be arrayed into units and stacked on top of one another.

28 Claims, 40 Drawing Sheets

STACKABLE, THIN-WALLED CONTAINERS HAVING A STRUCTURAL LOAD DISTRIBUTING FEATURE PERMITTING CASELESS SHIPPING

RELATED APPLICATIONS

This application claims the benefit of U.S. provisional application Ser. No. 60/052,775, filed Jul. 1, 1997.

BACKGROUND OF THE INVENTION

The present invention relates generally to receptacles and container structures. Specifically, the invention relates to molded, thin-walled containers that are capable of being stacked upon one another for storage and shipping purposes. For the purpose of clarification, caseless shipping is the ability to deliver products in a shipping container which requires no returnable, disposable, or replaceable cases.

To develop the concept of thin-walled containers an exemplary container will be used to reference thin-walled containers and establish a working definition that can be described, for example, as a ratio of the amount of plastic resin required to make a container relative to the amount of product capable of being transported in the container. To illustrate the concept, an industry standard gallon milk container should be used as the reference container for the development of the concept. Typical bottle weights for this container range from 90 grams (at the time the bottle was first introduced back in 1952) to 56 to 60 grams (as manufacturing technology progressed to today's standards).

In the field of art relating to the shipping and storage of bulk food products including milk and beverages, plastic molded containers are used to contain the products for transport, distribution, and ultimately for dispensing by consumers. Known containers usually take the form of blow-molded, one-piece plastic containers. The pour opening defines the uppermost wall or surface of the container and is generally located at the center of the container. A tapering region extends downwardly from the pour spout merging with four sidewalls that are disposed in substantially perpendicular relation relative to one another. A handle is integrally molded in the container and has a generally inverted L-shape. A first leg of the handle extends generally horizontally from the tapering region and a second leg of the handle extends generally vertically, merging with a sidewall junction of the container just above a base.

These containers are typically stored and shipped in some form of shipping case; consequently, these containers have been designed with little regard to the structural loading, stackability, and efficient packaging during transport. Unitized cases contain between four to six containers and take several different forms such as wire or plastic cases, corrugated boxes, or corrugated materials which provide structural support to the individual containers during shipping. These unitized cases are shown in FIGS. 1A (corrugated boxes) and 1B (plastic cases).

FIGS. 2A–2C illustrate several delivery mechanisms which are capable of shipping a large number of full containers which may or may not be unitized in cases. A brief description of the above shipping mechanisms will assist in further defining the principle of thin-walled, caseless shipping. Pallets (FIG. 2A) that support stackable cases are the most widespread form of shipping product for the retail or food service industry and the cases are the only returnable, reusable shipping mechanism considered by the industry. Bossies (FIG. 2B) and dollies (FIG. 2C) are primarily utilized by the dairy industry and are considered large, mechanical cases. There is a large cost associated with bossies and dollies since they have to be returned, cleaned, and reused in a similar fashion as the pallet cases.

For further discussion, the caseless concept will be defined on the pallet shipping mechanism as described below.

Cases can be stacked on pallets in several different configurations based on the pallet footprint. Typical pallets will have approximately two-hundred to two-hundred-fifty containers shipped on them and will be stacked from four to six cases high depending on the pallet size. The forces associated with these cases is evident from a consideration of the weight of a three liter milk container that is approximately six to seven pounds (or approximately eight and one-half pounds per gallon). The structure and strength of these cases make them ideal for stacking thin-walled containers that carry a dense product, however, their use has been problematic. The actual case costs are relatively inexpensive and are intended to be reused with a typical life of two years; however, the cases are often misappropriated by vandals or thieves for use in other applications, i.e., as storage containers for different articles. The cost associated with cases really occurs at the manufacturing facility and during distribution.

To understand the impact of caseless shipping in manufacturing facilities using cases, it is important that an appreciation of the current method for casing product be attained. The majority of the dairy industry uses plastic cases to some significant measure if they do not use them exclusively. The basic cycle of a case is as follows:

Cases are purchased for a price of approximately $2.00 (sixteen quart case) and are entered into the already large inventory of cases on an as needed basis. Even in the best operations, this replenishment process is driven by damage, new business, theft, customer accumulation, etc. In some instances, this replacement initiative is quite extensive and demands a significant portion of management time in order to maintain control of the case supply.

During a typical production day, cases must be continually fed to the facility as product is produced. This requires several people dedicated to move and unload trailers of empty cases as they return from the routes and one person dedicated to ensure that a continual supply of cases are maintained during production hours. In addition, large, covered areas are needed to house empty cases which requires maintenance and upkeep. Inventory costs associated with these cases need to be considered and can be rather extensive based on the size of the dairy. FIGS. 3 and 4 illustrate some of the space requirements associated with cases.

After the cases are unloaded and start through the production process, the cases must be destacked in the proper orientation to be prepped for container filling. FIGS. 5A and 5B illustrate a typical destacker system. The maintenance fees for this system have a percentage impact on the cost of goods. Continual supervision is required to ensure the destacker does not jam or prevent cases from flowing to the next pre-production stage.

Cases are then moved to the case cleaning system in which extremely caustic cleansers wash and clean the cases prior to container filling. The cleansers affect cost to the system by increasing sewer bills, replacement and maintenance of the equipment and expensive cleansers. FIG. 6 illustrates typical case washing equipment.

The cases are then conveyed to the filling process. The cases are loaded through automatic casing equipment and combined into stacks of five or six case heights. These stacks are conveyed into refrigerated areas where they are placed into storage positions for later retrieval as illustrated in FIGS. 7A–7C.

Distribution costs also impact on the costs associated with shipping these containers. Hooking, track shipping, or automated material handling systems are several methods for storing and retrieving filled cases. These methods are illustrated in FIGS. 8A–8D such as using hooks to pull cases (FIG. 8A), track shipping (FIG. 8B), using a pallet jack (FIG. 8C), and it should be noted that the automated material handling systems (FIG. 9) require large superstructures to house the cased product and are very capital intensive.

The containers are then shipped by various means in these cases. Depending on the system, the customer, and the demand, the containers will be pulled from various storage systems by the techniques illustrated above and loaded onto a distribution vehicle for delivery to a customer.

Depending on the type of distribution business considered, distribution expense may range from being very important to the most important issue in succeeding in a business. For a distributor, food service, or wholesaler who manufactures no products, the warehousing and distribution costs are likely the most crucial to the success of the business. Operational efficiencies depend on excelling in these areas. As a result, warehouses and distribution methods have been designed to return only the industry standard pallets. Reluctantly, and with substantial costs, many distributors handle product in cases with hopes that a corrugated alternative may become cost effective in the future. Smaller, more service-oriented distributors clearly recognize the value of eliminating returnable cases as the delivery person becomes much more efficient resulting from the elimination of non-value adding activities.

As stated above, the primary method for many customers to receive product is primarily on pallets or cases stacked on the floor. Though other variations exist, the fundamental economics are associated with these two methods.

Depending on the size of the customer, a typical trailer may have one to twelve customer orders to be delivered. The orders are loaded on the trailer in by stop sequence. A driver's typical delivery day is described below. The first customer will be delivered and the product will be taken to the cooler. Empty cases will be loaded onto pallets and wrapped with tape or shrink wrap to maintain a stable load. These pallets are then loaded into the back of the truck to be returned to the production facility at the end of the route as illustrated in FIG. 10.

The driver then departs to deliver to the next customer. One of two solutions occur. First, if the trailer was completely loaded such that there was very little room, the driver will have to unload the empty cases he just loaded at the previous stop before he can begin to deliver the next customer. Alternatively, if the trailer is partially full, the driver may have sufficient room to work and may not have to rotate empty cases until later stops. It should be noted that the practice of maximizing trailer loads to the back door is the norm to minimize distribution costs. The above empty case rotation is continued until all product is delivered and all of the empty cases are collected.

The critical steps for case delivery are summarized below:

1. Drive to the stop
2. Unload product for delivery
3. Load empty cases
4. Drive to stop
5. Unload empty cases
6. Unload product for delivery
7. Load new and old empty cases and/or rotate load
8. Drive to stop
9. Repeat until load is complete It is envisioned that caseless shipping would have enormous benefits and labor savings associated with, for example, the distribution, the critical steps for delivery are summarized below:

1. Drive to stop
2. Deliver purchases material
3. Pick up pallet(s)
4. Drive to next stop
5. Deliver purchased material
6. Pick up pallet(s)
7. Repeat until load is complete The difference is the lack of non-value services required. As is realized, there is no wasted time collecting empty cases or rotating product and empty cases on the trucks. Other obvious savings are better utilization of trailer loads because no space needs to be allocated for cases and route efficiencies can be enjoyed and potential for back hauls can be achieved. Also, if the trailer is not full because of time constraints, more time on the route will be enjoyed and more stops placed on the route because time will not be lost collecting empty cases.

The current mode of handling cases have a per unit distribution expense which can be drastically reduced. Based on simple arithmetic, it has been estimated that the improvement might be as much as 30%.

In addition to the problems associated with transporting and shipping with cases as described above, the production of the individual plastic containers widely used in the dairy industry is another area requiring improvement, e.g. reduced production cost. A typical milk production facility will manufacture or purchase millions of these containers per year. A cost savings of one-cent in material resin cost is significant when applied to the number of containers involved. As a result, there has been much effort in the past to minimize the material costs without compromising container integrity. It should be noted that the processing and distribution costs are much larger than the cost associated with the resin for a production facility. Thus, a need exists to produce a container with similar amounts of resin as used today (i.e., thin-walled) while eliminating cases and all of the associated costs described above.

Design efforts relating to containers for food have also focused on aesthetic appeal and consumer benefits. For example, a pitcher-like construction which is easy to grasp and tilt and which provides for easy pourability of the contained product may be desirable from a marketing perspective. Similarly, the container should incorporate non-drip characteristics and eliminate or reduce the potential for "glugging" caused by a lack of venting air into the container during pouring.

It would, therefore, be desirable to provide a container structure which provides for stackability and which eliminates the need for cases or shippers during bulk transport. It would be further desirable to provide a container structure which provides enhanced strength, as well as the above-mentioned consumer benefits, without adding to the material costs involved in its manufacture.

SUMMARY OF THE INVENTION

The present invention contemplates new and improved containers which eliminate the need for cases or shippers and which provide increased strength for supporting static or dynamic vertical loads, thereby facilitating stacking on pallets without the use of cases while maintaining costs for manufacture.

In accordance with the present invention, there is provided a container for a comestible product such as milk or juice that has a base with a substantially planar region, a top surface with a substantially planar surface and a pour spout, a sidewall interposed between the top surface and the base, and a structural load distributing feature for conveying bearing loads from the substantially planar surface of the top surface to the base.

According to another aspect of the invention, the structural load distributing feature is integrally molded into the sidewall of the container.

According to another aspect of the invention, the structural load distributing feature is provided in part by a sectional wraparound label.

According to another aspect of the invention, the container is manufactured of a plastic material having a weight to volume ratio of approximately fifty-five to seventy grams per gallon (approximately eighteen to twenty-four grams per liter).

According to yet another aspect of the invention, the pour spout is disposed adjacent an edge of the container and the center of gravity is disposed closer to the pour spout than the handle.

According to another aspect of the invention, a caseless, liquid handling system includes plural similarly configured containers, a preselected number of containers held together as a unit with a first flexible wrapping material, and multiple container units held in grouped and stacked array by a second flexible wrapping material.

A primary advantage of the invention resides in the cost savings associated with eliminating the use of cases to handle, store and transport the containers.

Another advantage of the invention is found in the various consumer benefits such as a pitcher-like shape with improved pourability characteristics.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in the specification illustrated in the accompanying drawings which form a part hereof, wherein.

DETAILED DESCRIPTION OF THE PREFERRED EMBODIMENTS

Figure 1A:
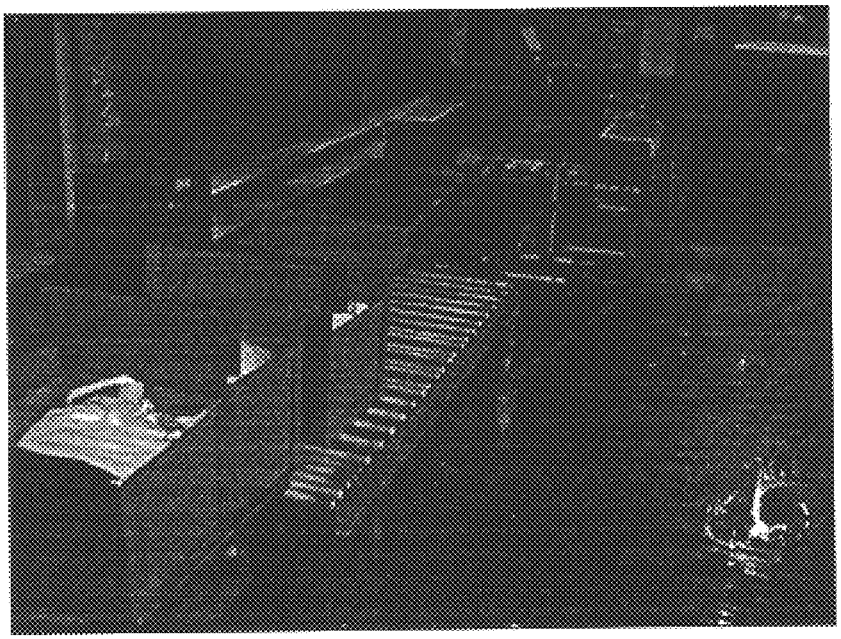
FIGS. 1A and 1B show industry standard cases for handling milk.

Referring now to the drawings wherein the showings are for the purpose of illustrating the preferred embodiments of the invention only and not for purposes of limiting the same, the Figures show the present manner of shipping, storage, and handling individual milk containers in cases (FIGS.

1–10 described above in the Background section), and a number of embodiments of new containers according to the present invention that advantageously provide a caseless shipping system (FIGS. 11–40).

Figure 12:
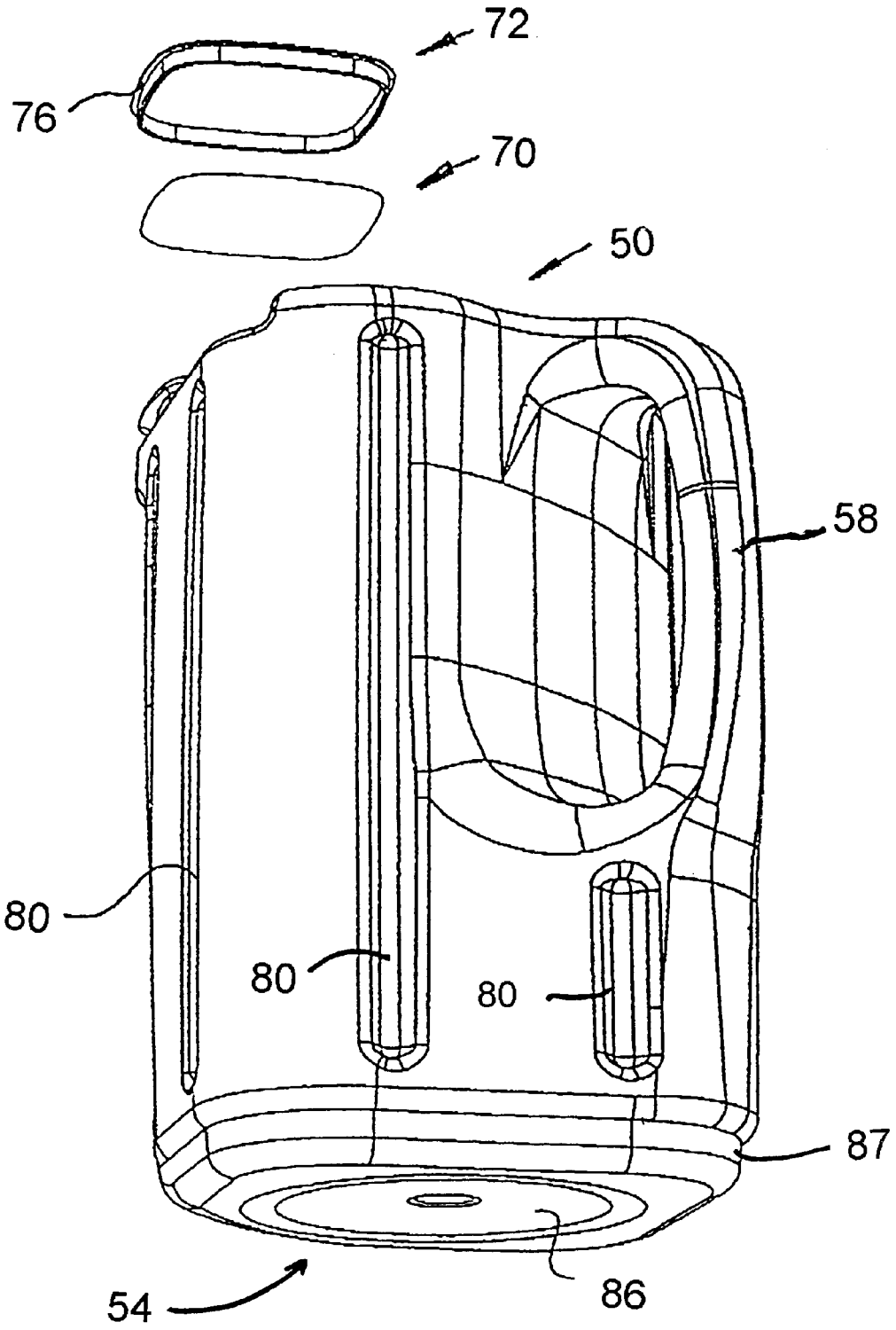
FIG. 12 is another perspective view of the first preferred embodiment of a container according to the present invention.
Figure 13:
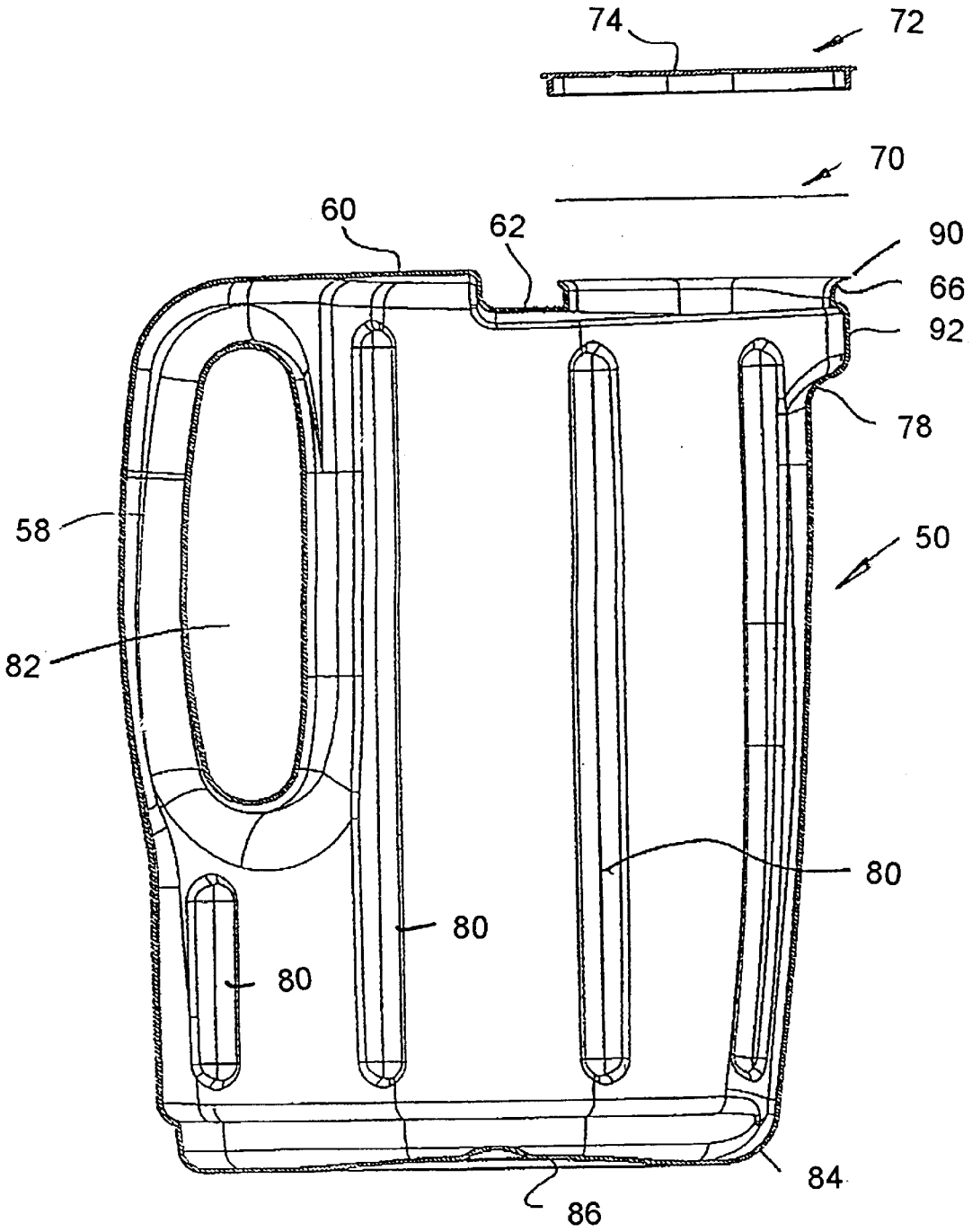
FIG. 13 is a sectional view of the container illustrated in FIGS. 11 and 12.

Referring to FIGS. 11–13, a container according to the present invention is designated generally by the number 50 and may be a standard (3-liter or 1 gallon) size container or any other size. Those of ordinary skill will recognize that the container structures described herein are scalable to achieve virtually any size comprising a blow-molded plastic, although different manufacturing techniques may be used. Container 50 comprises a top surface 52, bottom 54 and a wall 56 molded integrally therewith. The top surface 52 and bottom 54 are of a generally diamond shape with an apex thereof coinciding with integrally molded handle 58. The handle proceeds from the top surface along the apex and terminates before reaching the bottom.

The top surface 52 includes a stepped conformation having an upper surface 60 and lower level deck portion 62 which is slightly vertically recessed from upper surface 60. An orifice 64 is formed in deck portion 62 for egress of the liquid or other material contained in container 50. A pouring lip 66 extends upwardly from the deck portion 62 to form a pouring spout 68 which is of generally diamond shape. A foil seal 70 is provided for tamper resistance and detection as well as enhanced sealing capabilities. A snap-on cap 72 cooperates with foil seal 70 and pouring spout 68. Seal 70 and cap 72 are of a diamond shape to simplify automation of the capping process during container filling. Orifice 64 is generally sized to permit simultaneous egress of fluid and ingress of air to prevent "glugging." A secondary function of the large orifice 64 is that it provides for easy ingress of fluid and/or powder mixture to the container during reuse or initial filling of the container. The orifice also permits the easy deployment of stirring utensils within the container. It will be appreciated that when fluid is poured from container, fluid flows over one apex of the diamond shape of the spout. Cap upper surface 74 is aligned with container upper surface 60 when cap 72 is snapped into place. This provides a large upper stacking surface that is substantially planar for increased stability and vertical load support. A finger grip ledge 76 is provided on cap 72 to permit removal thereof. Pouring spout 68 extends outward in a direction opposite handle 58 beyond wall 56 to form a cup guide 78, which functions to permit a cup (not shown) to be correctly oriented to permit spill-free pouring.

According to one aspect of the invention, wall 56 is formed with a number of structural load distributing or load transferring features such as vertical ribs 80 which increase the sectional modulus of wall 56 and prevent bending and/or buckling. Ribs 80 are preferably of a "V" shape in cross-section, with the apex of the "V" extending inward of the container and are substantially continuous along the longitudinal height of the container (see FIGS. 11–13). This structure permits the construction of manufacturing molds without the presence of undercuts, which are inefficient from a manufacturing standpoint. Preferably, vertical ribs 80 are incorporated into vertical surfaces of wall 56 in an effort to reduce the unbraced length of the wall and limit deflections. For example, walls may otherwise be subject to buckling or crimping as a result of vertical loads or forces while bulging may be associated with hydrostatic forces. Thus, those wall regions which are taller than four inches in a three liter container, for example, would benefit from a change in the section modulus to limit deflections. This structure will provide the container with the rigidity required for supporting and transferring the load from one container to another in a stacked relation—which the prior milk containers described in the Background were unable to achieve.

A sectional wraparound label (not shown) may be incorporated to add further strength and structural integrity. For example, the wraparound label can be used to purposely add a preload to the container and limit the deflections. Alternatively, the structural load distributing feature may be a series of diagonal reinforcements (FIG. 11B), offset ribs (FIG. 11C), dimples (FIG. 11D), or combination of these features that are effective in transferring forces from the top surface to the bottom of the container. These are preferred alternative ways to change the section modulus and transfer vertical forces through the container. The handle, since it extends from the substantially planar top surface of the container, is also an important element in the load bearing arrangement.

Handle 58 is formed integrally with the container 50. One end of handle 58 extends from upper surface 60 of the container to provide additional support thereto. An opposite or lower end of handle 58 extends or merges into wall 56. A finger clearance hole 82 (FIG. 13) provides comfort for a large range of hand sizes of consumers. The finger receiving region is thus disposed adjacent the handle and preferably terminates before reaching the base of the container. Handle 58 extends in a direction that is directly opposite the apex of pouring spout 68 to provide self-centering of the spout. The construction of the handle also functions in the handling of container arrayed into groups or container units as will be further explained below.

Container bottom 54 is provided with a pouring radius 84 which extends into wall 56. Pouring radius 84 is constructed to permit pivoting of the container on a support surface when pouring without lifting is desired. This aspect of the invention is especially beneficial to users, i.e., children or senior citizens, who have relatively little strength or are physically challenged. Container bottom 54 is formed with a lower surface 86 which is slightly concave (FIG. 12) when the container is empty, but which flattens out when the container is filled with liquid such as milk or fruit juice to form a generally horizontal surface. As will be appreciated, lower surface 86, together with the upper surface 60 of an adjacent container (not shown), cooperate such that vertical loads are evenly distributed among and across the container surfaces. As shown in FIGS. 12 and 13, wall 56 extends to a slight recess 87 at container bottom 54.

Figure 14:
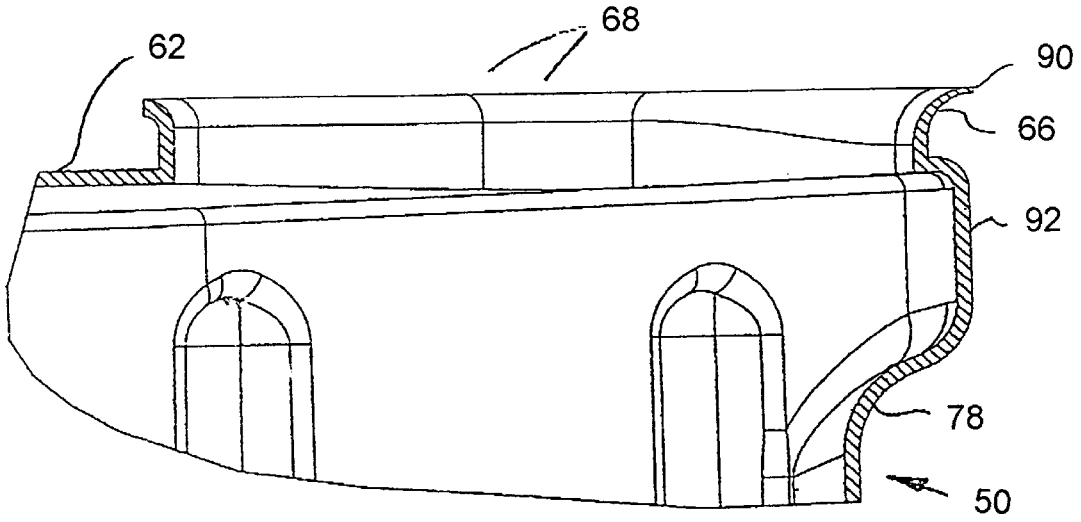
FIG. 14 is an enlarged sectional view of the upper and lower spout of the embodiment illustrated in FIGS. 11–13.

FIG. 14 is a sectional view of the pouring spout 68 according to the present invention. Pouring lip 66 includes a pouring edge 90 that curves sharply downward at its extremity to create an anti-drip spout. Edge 90 is displaced outward slightly from the outermost surface of lower pour spout 92. This configuration prevents liquid from running down the front of container 50. Cup guide 78 extends downward and inward from lower pour spout 92 to facilitate proper orientation of the pour spout relative to a cup.

Figure 15:
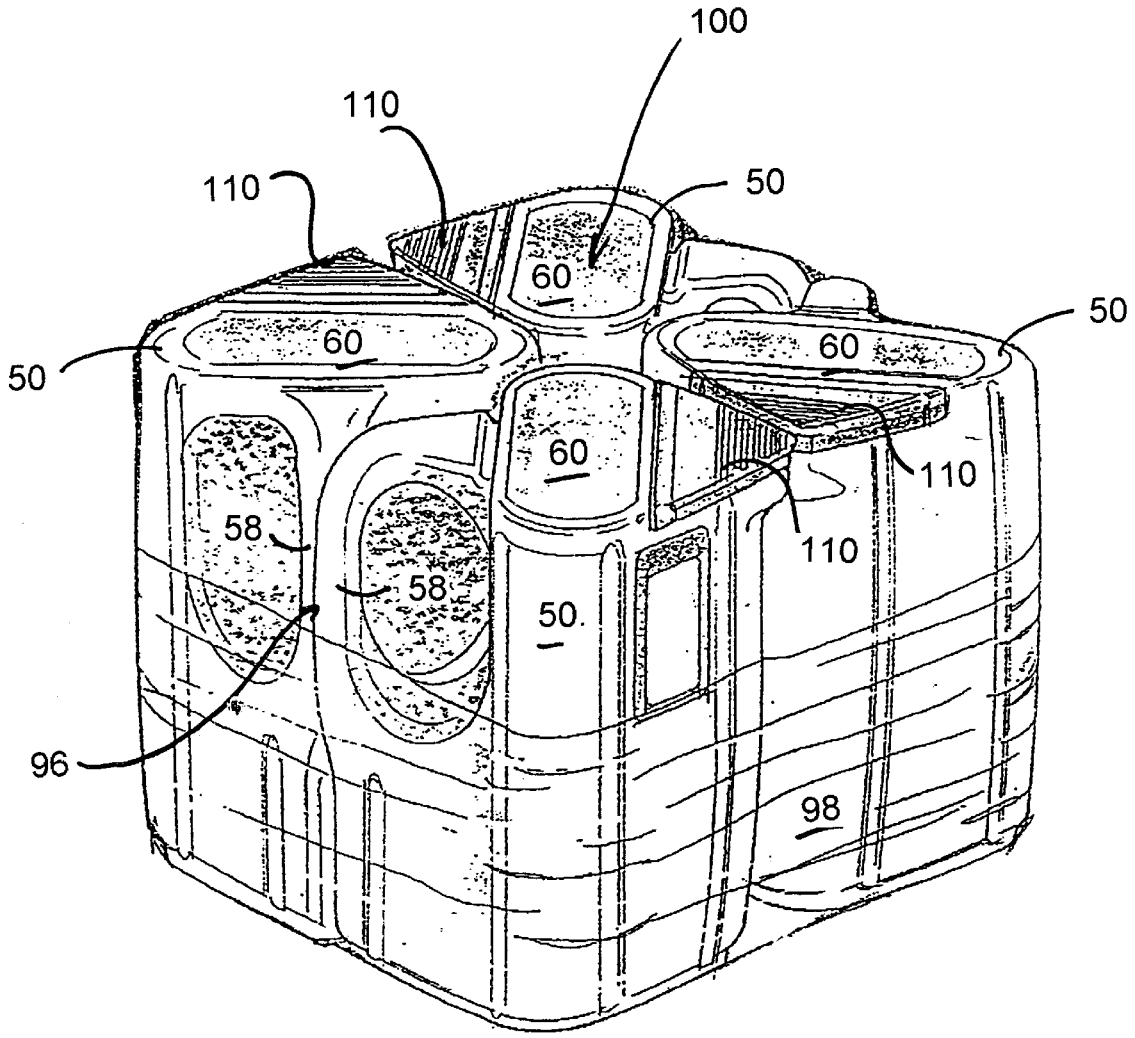
FIG. 15 is a perspective of a grouping of four of the containers according to a preferred embodiment of the present invention.
Figure 16:
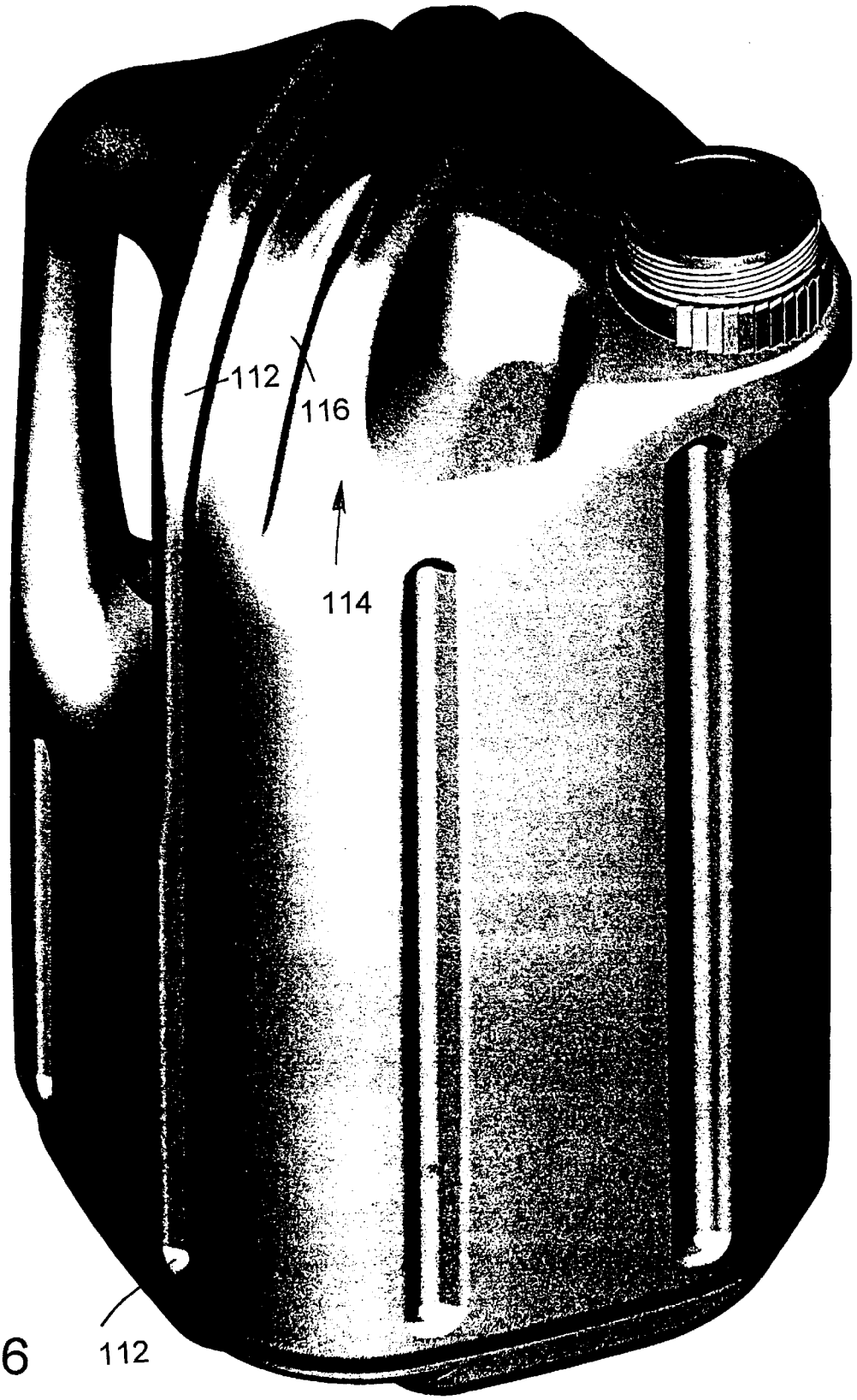
FIGS. 16–18 are perspective views of a second preferred embodiment.
Figure 17:
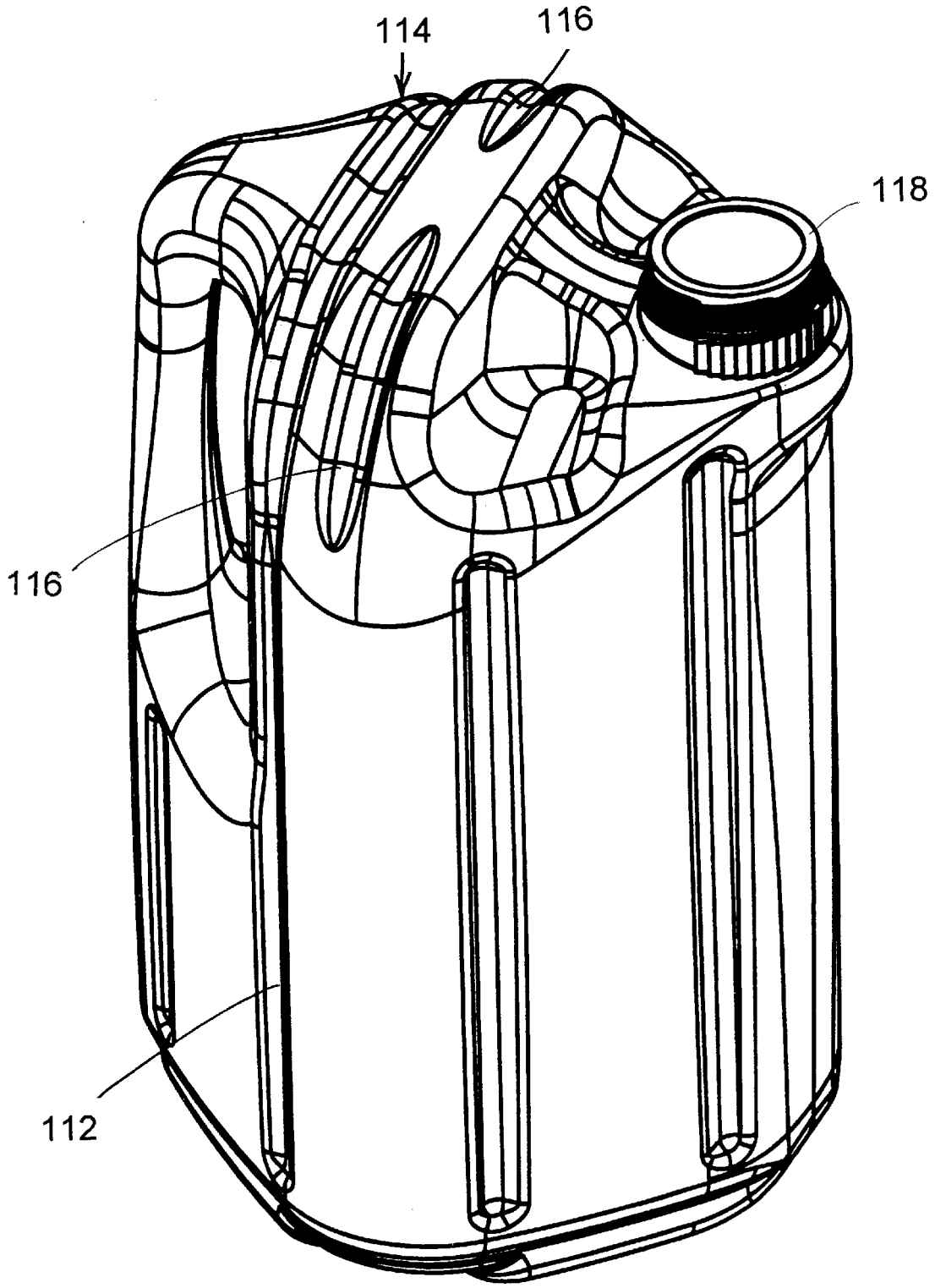

FIG. 15 illustrates a grouping of four containers 50 according to a preferred embodiment of the invention. It will be recognized that two adjacent containers are disposed with their respective handles 58 adjacent one another to form a combined carrying handle 96. On an opposite side of the container grouping, two more handles 58 are similarly situated to from a second combined handle when arrayed in this fashion. Two carrying handles 96, each comprising a pair of adjacent container handles 58 are provided on opposite sides of the grouping to permit easy handling thereof Of course, other numbers of containers (e.g., six containers which may be preferred for brick-like stacking on a pallet) can be grouped together to form a unit and the handles oriented in a different manner such as at the corners of the group unit.

The four to six containers comprising the grouping unit are held together with a first flexible material, preferably a shrink wrap thermoplastic 98. As can be seen in FIG. 15, a large combined upper support surface 100 is provided by the respective upper surfaces 60 of the containers 50. The first flexible material holds the individual containers in a desired orientation that is stable and capable of being positioned into a layer of units that define a first level of a stacked array.

Each of the containers in the grouping shown in FIG. 15 are provided with a flip top 110 which may be hinged to the container 50 using suitable means. Flip top 110 may be equipped with a recess or projection for engaging the pouring spout (not shown in FIG. 15). It will be recognized that the flip top 110 provides an extension of the top surface 60 such that a load imposes on the top surface of the container grouping is more evenly distributed and supported by a substantially planar surface.

Figure 18:
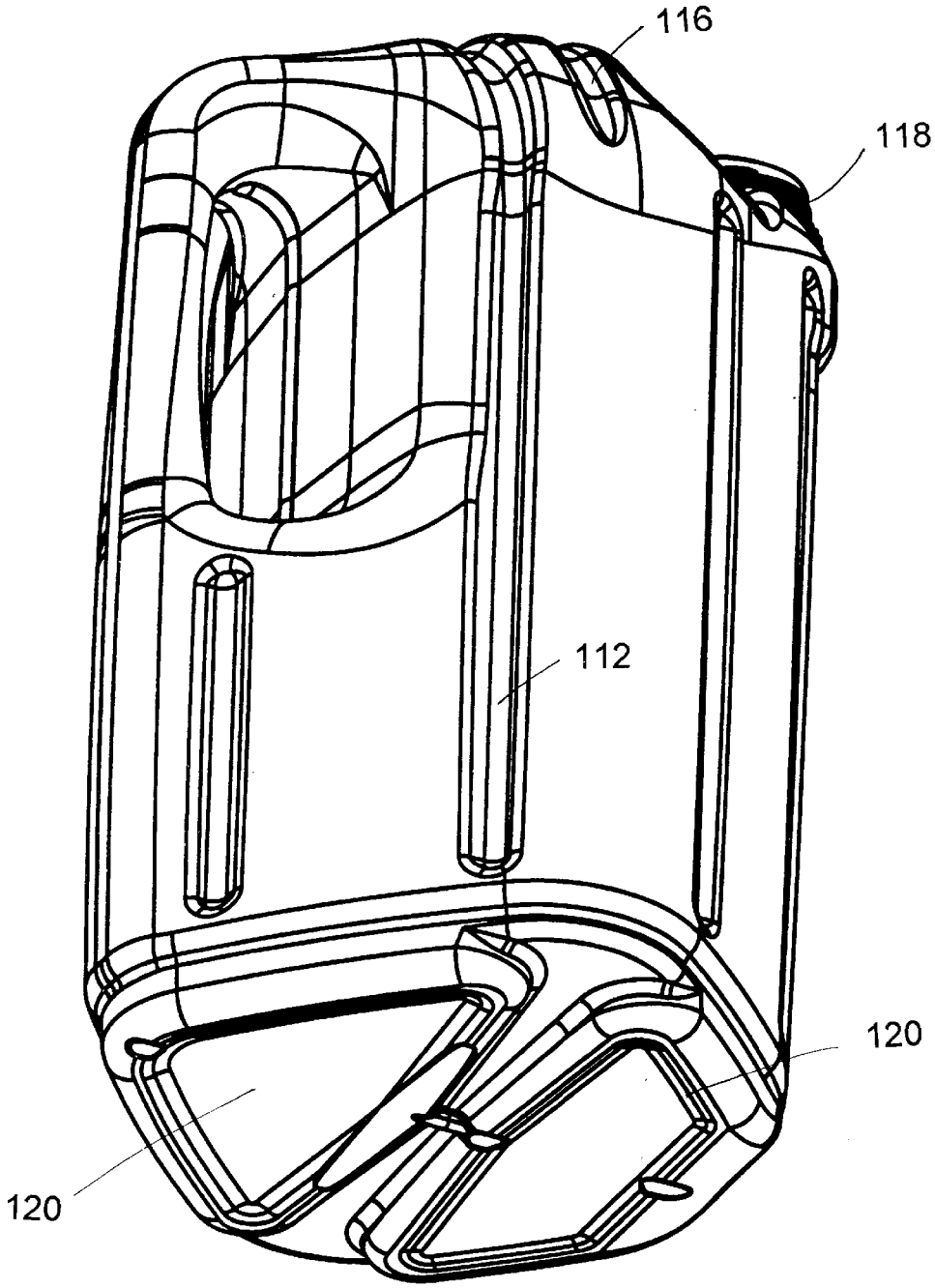
Figure 19:
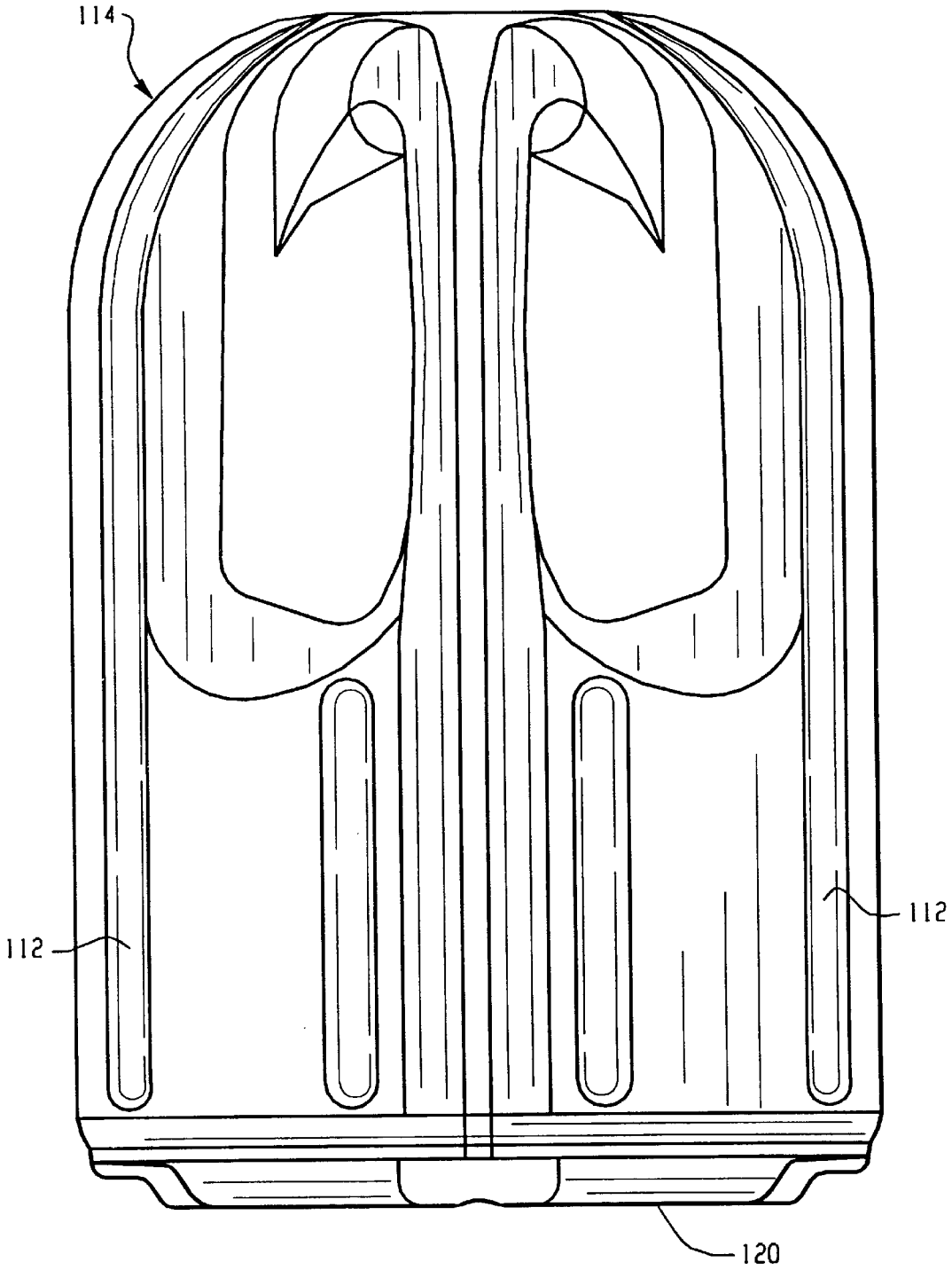
FIG. 19 is a rear elevational view of the second preferred embodiment.
Figure 20:
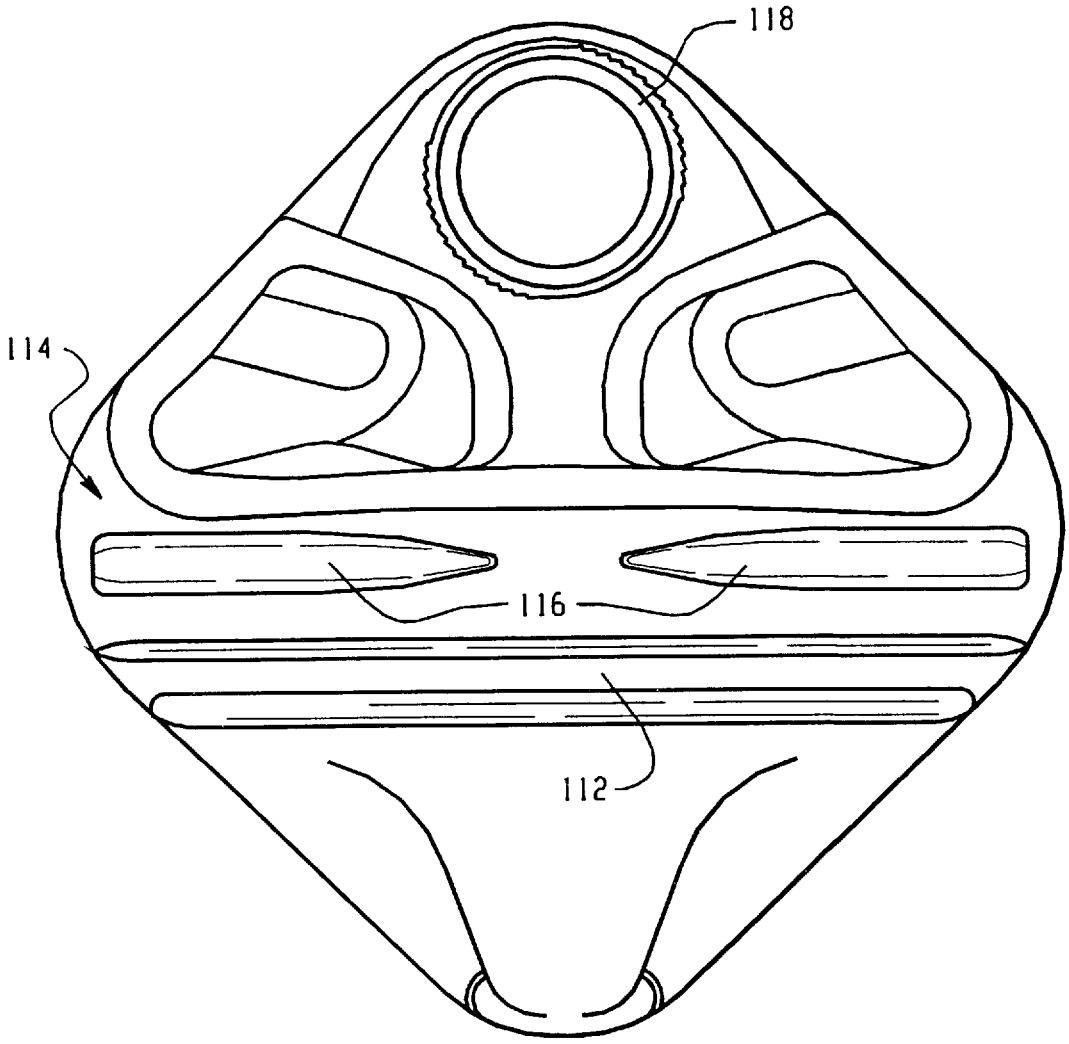
FIG. 20 is a top plan view of the second embodiment.
Figure 21:
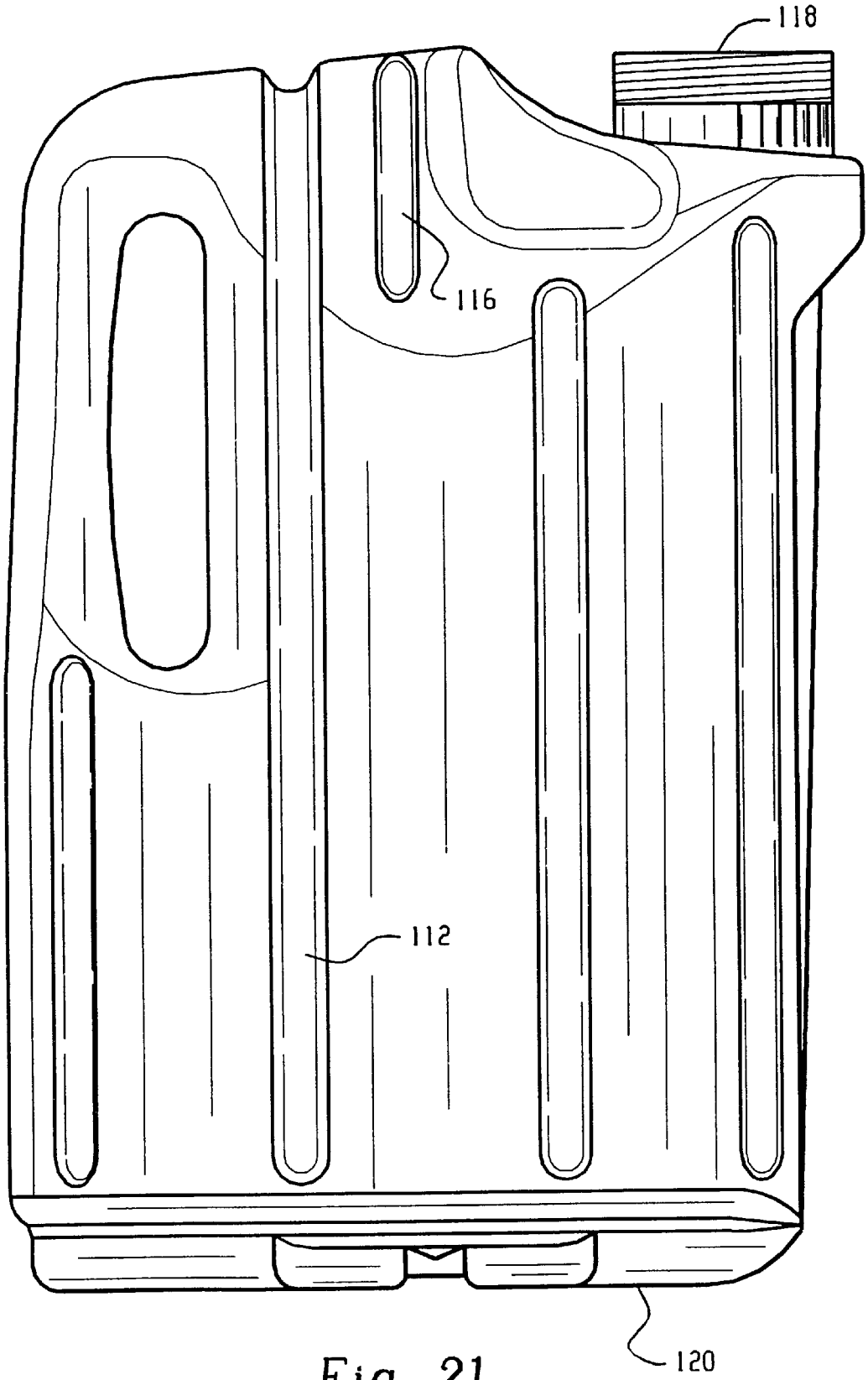
FIG. 21 is a side elevational view taken generally from the right-hand side of FIG. 19.
Figure 22:
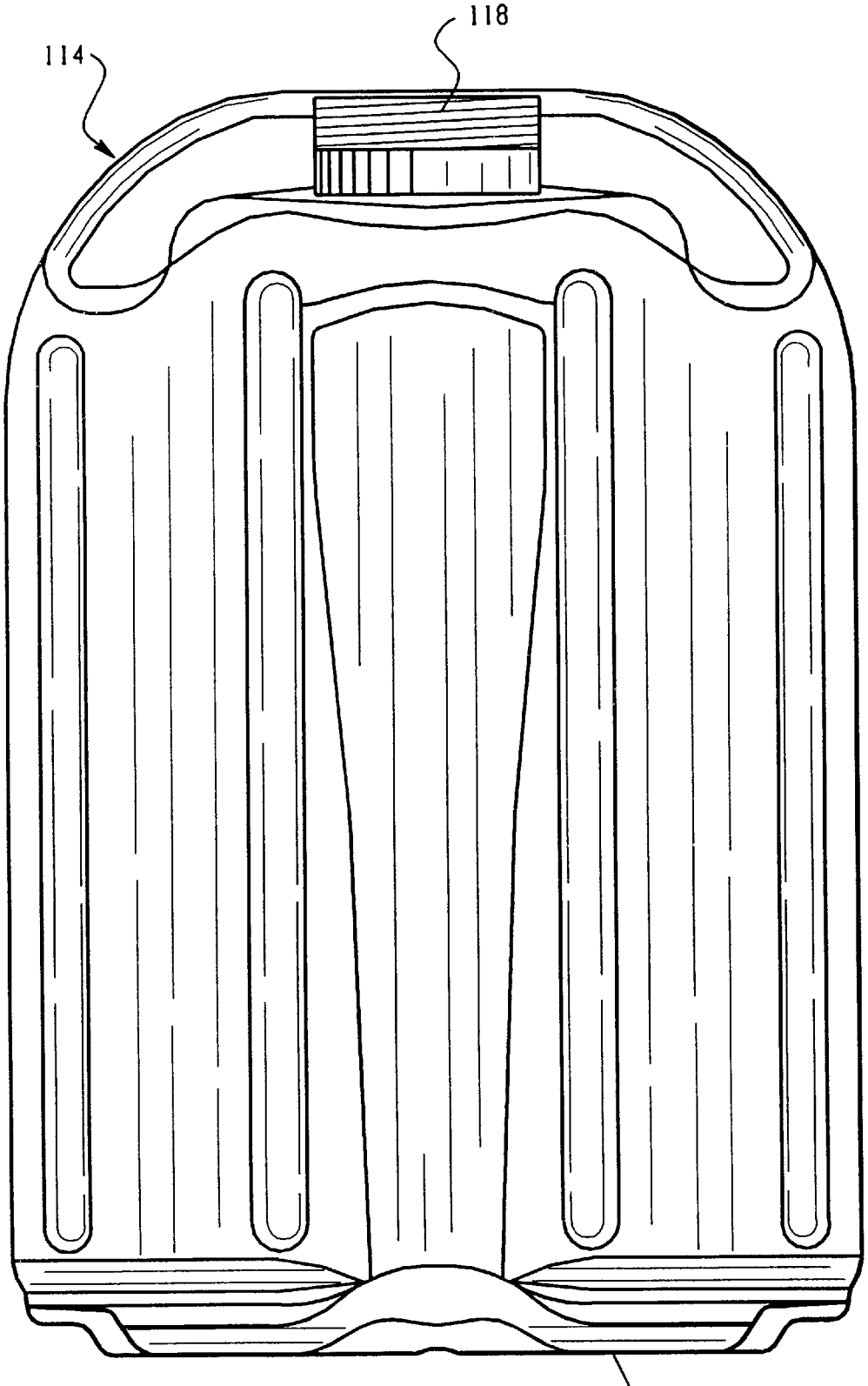
FIG. 22 is a front view of the second embodiment.
Figure 23:
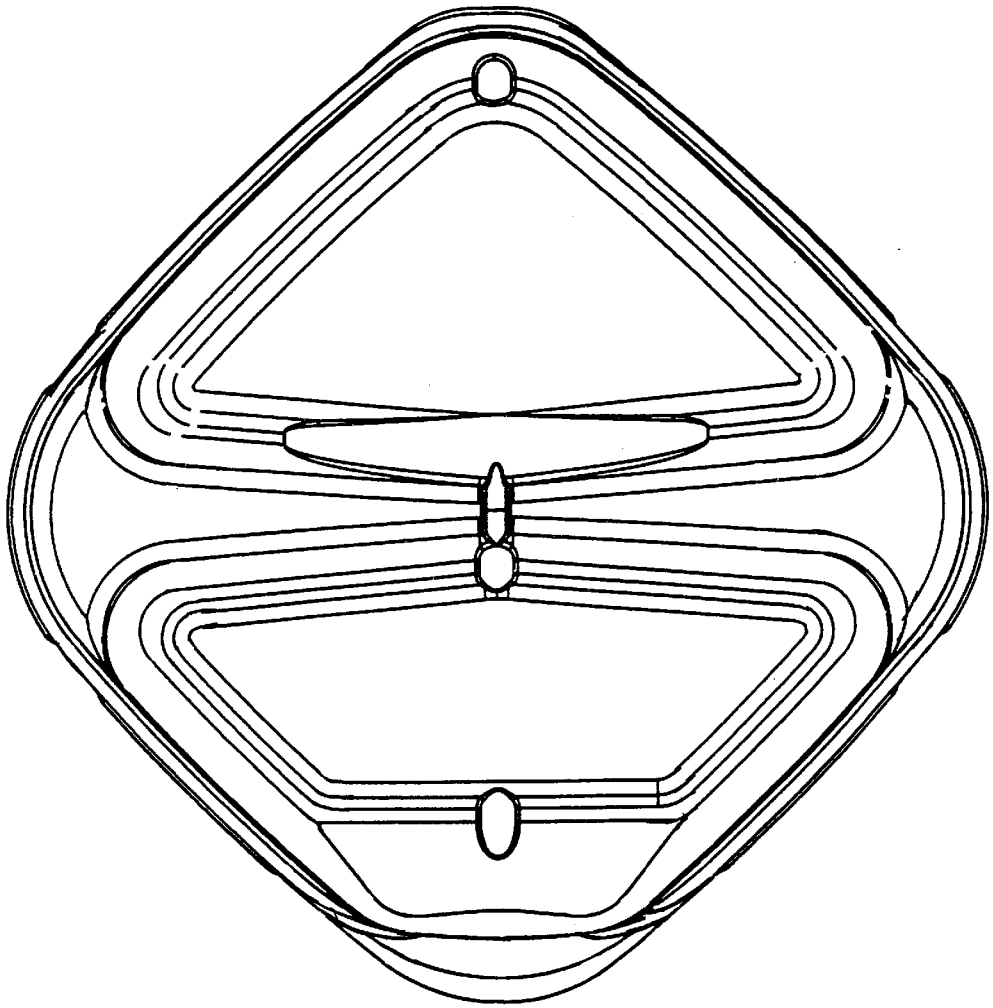
FIG. 23 is a bottom plan view of the second embodiment.

FIGS. 16–23 show a second preferred embodiment of the invention that has many similarities to the embodiment described above in conjunction with FIGS. 11–15. Accordingly, the differences will be emphasized here and identified by new numerals. For example, at least one of the structural load distributing ribs or flutes is a continuous flute 112 that proceeds through the substantially planar surface of the top surface and down opposite sides of the container toward the base. Preferably this flute is situated between the pour spout and the handle. In addition, the top surface is modified to have a slight arch 114 thereto which is effective in transferring the forces from the top surface to the base. Additional flutes or ribs 116 are also provided in the top surface in the arch region and terminate in the upper portion of the container. The pour spout area is also modified, eliminating the flip top (FIG. 15) and the diamond-shaped cap (FIG. 11A), with a more conventional replaceable push on, screw-off type cap 118, also known as a snap cap. As is evident, however, the screw-on cap is located so that it can serve as a part of the top surface (FIG. 22), particularly the substantially planar surface, for transferring loads from containers stacked on top thereof. FIG. 18 illustrates that the bottom or base of the container is also modified relative to that shown in FIG. 12. It still serves, however, to define a substantially planar surface 120 that transfers loads to a next adjacent layer of containers, a pallet, or the like.

Figure 24:
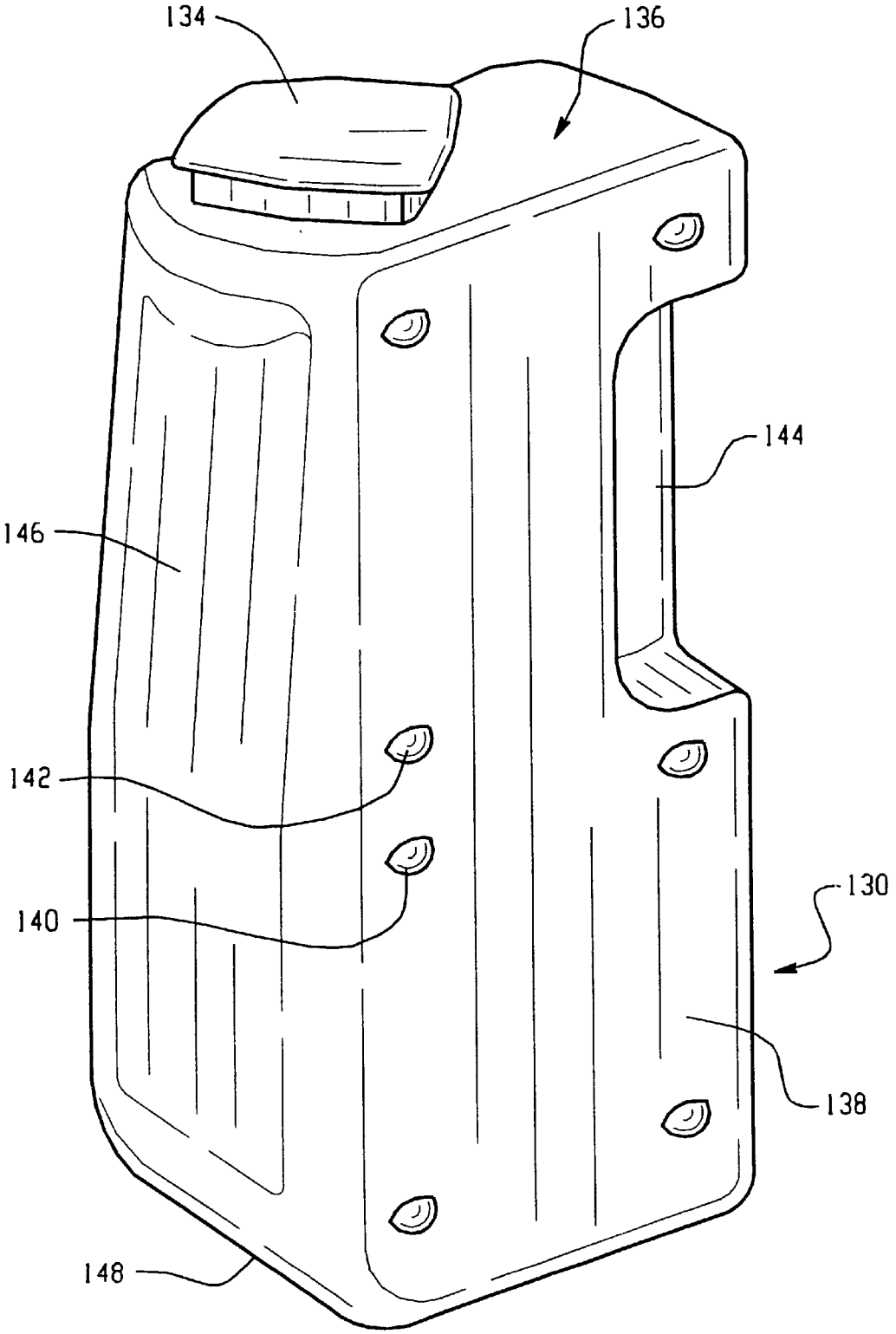
FIG. 24 is a perspective of a third preferred embodiment of the present invention.
Figure 25:
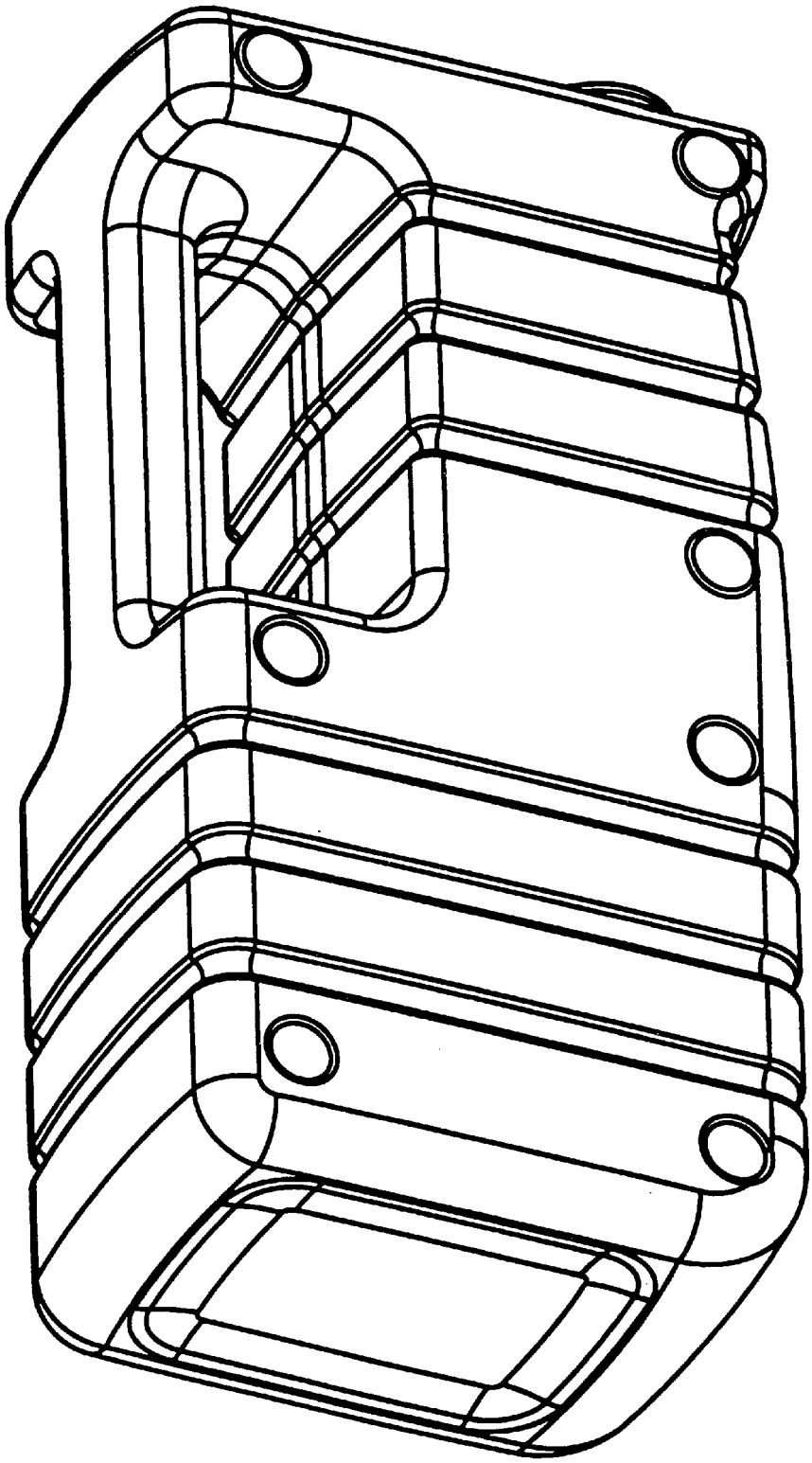
FIGS. 25 and 26 are perspective views of a fourth preferred embodiment of the present invention.
Figure 26:
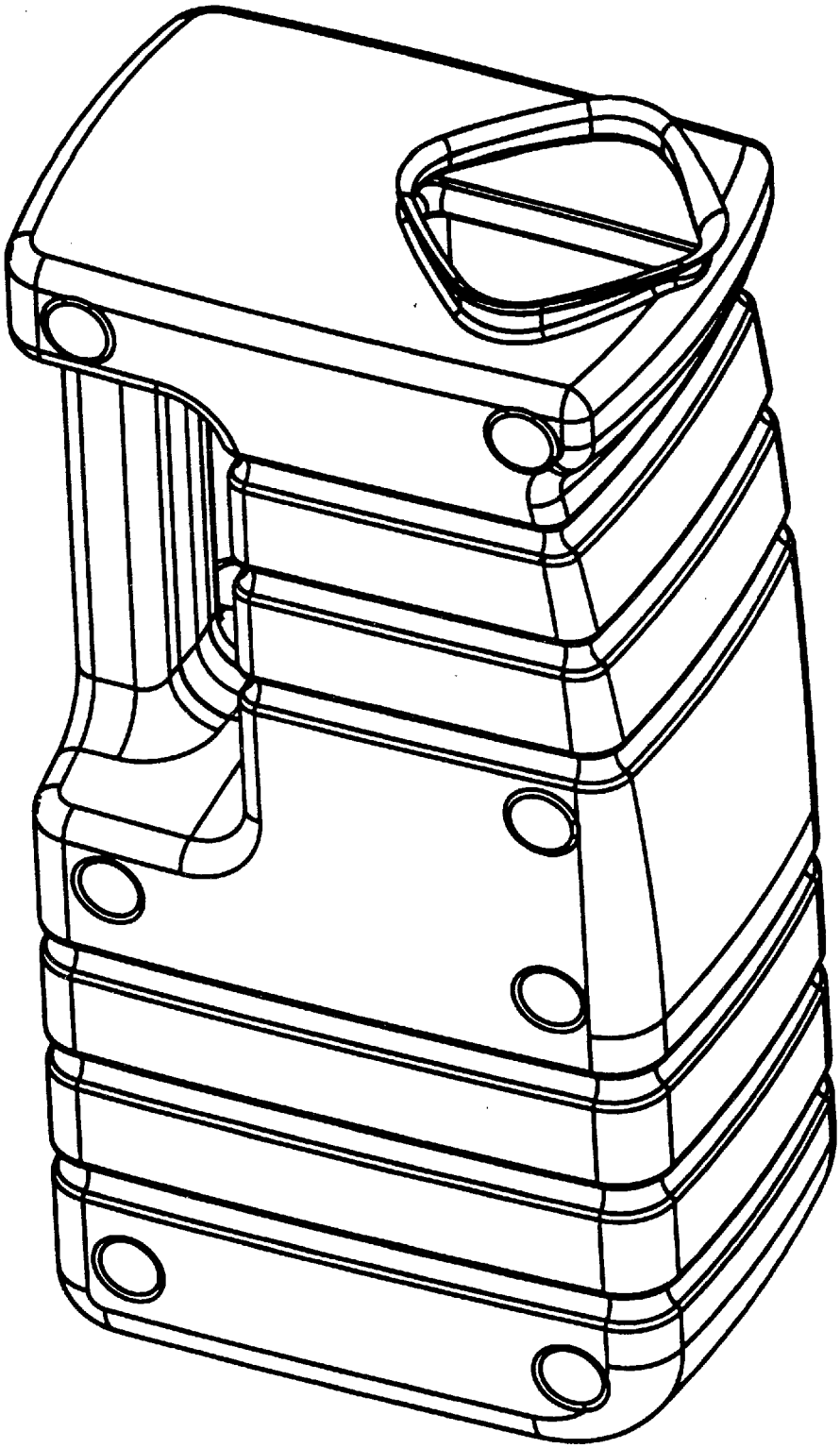
Figure 27:
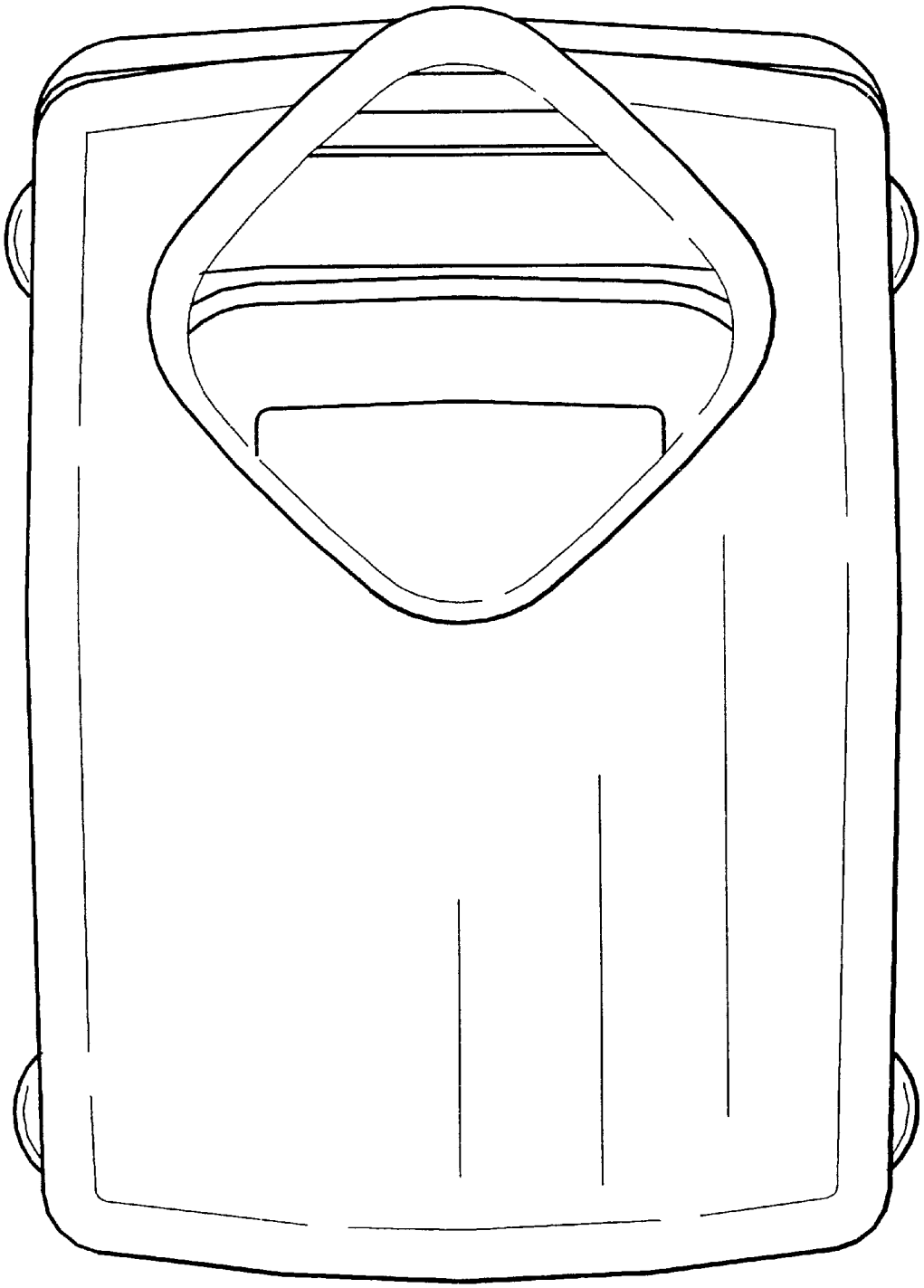
FIG. 27 is a top plan view of the fourth embodiment.
Figure 28:
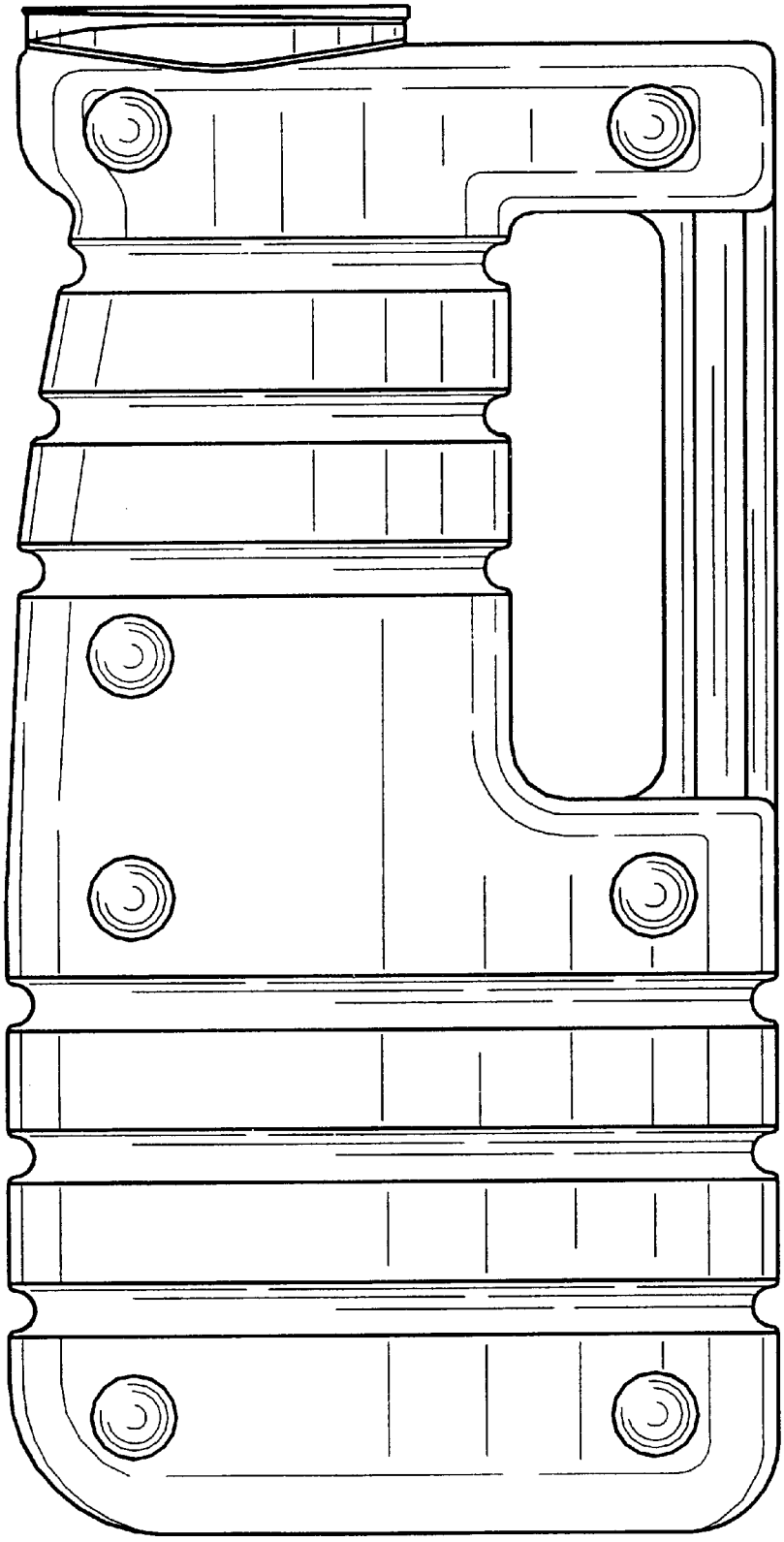
FIGS. 28 and 29 are side elevational views of the fourth embodiment.
Figure 29:
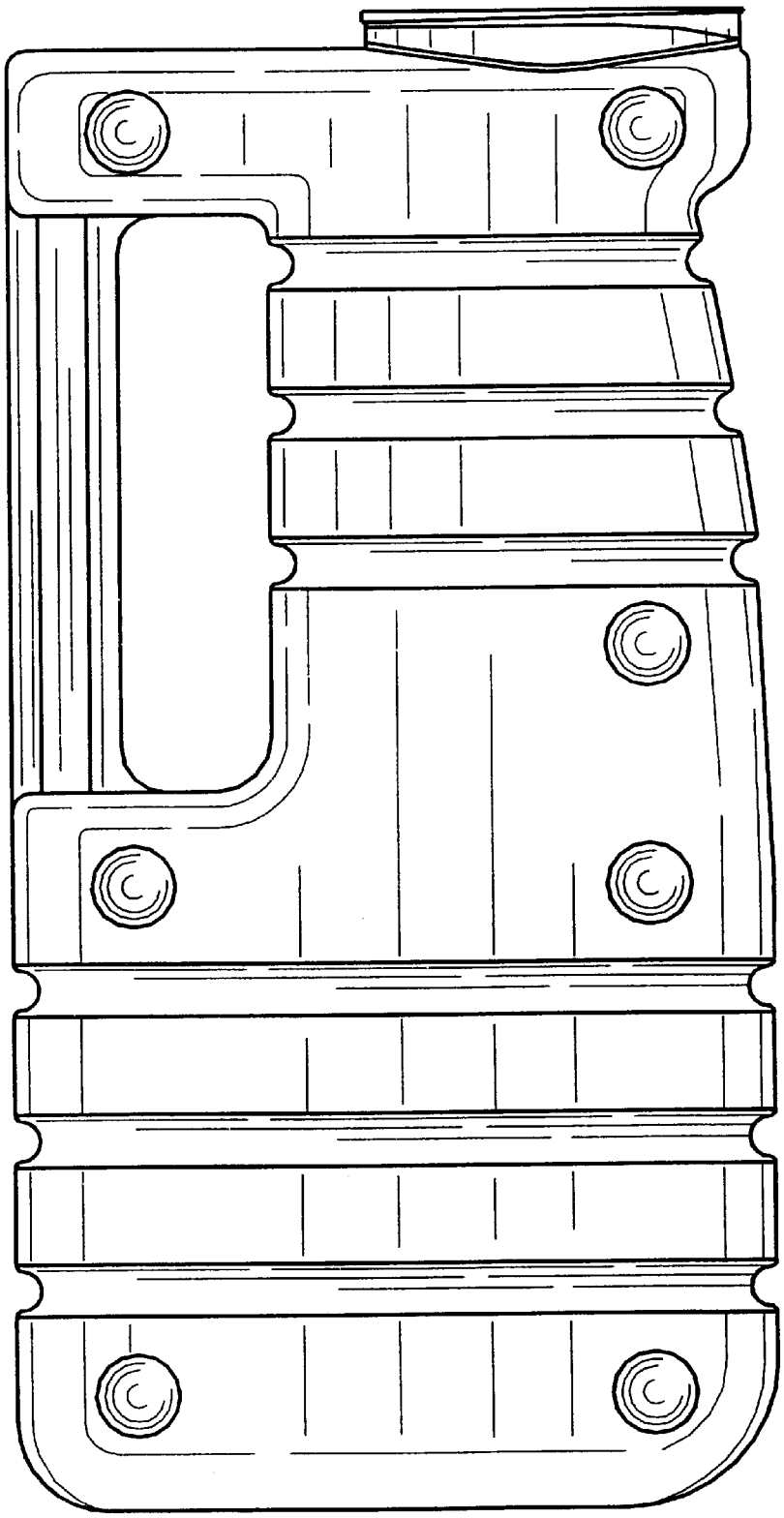
Figure 30:
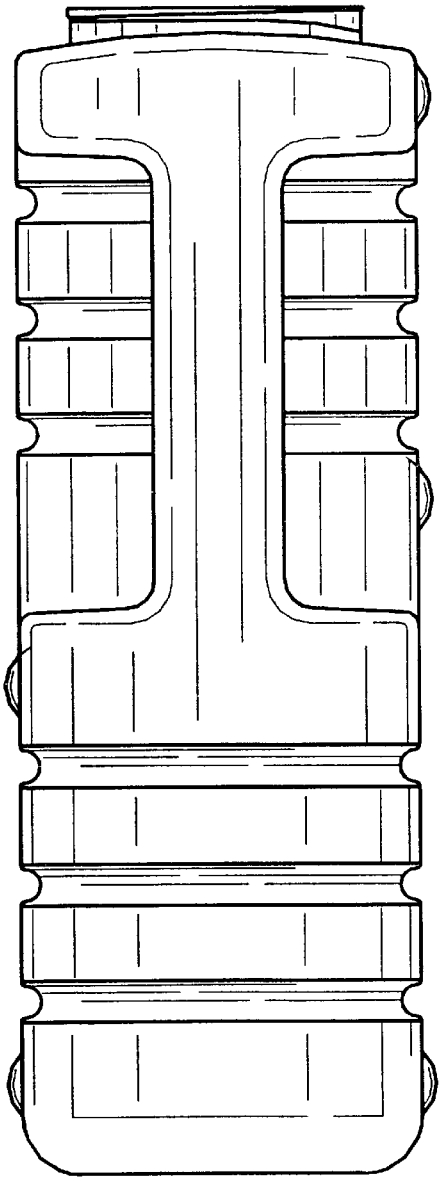
FIG. 30 is a rear elevational view of the fourth embodiment.
Figure 31:
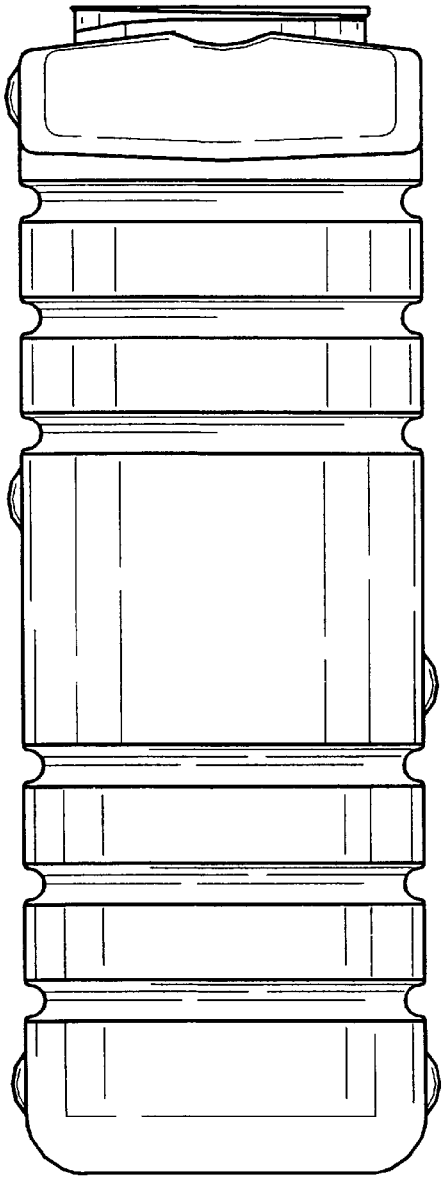
FIG. 31 is a front elevational view of the fourth embodiment.
Figure 32:
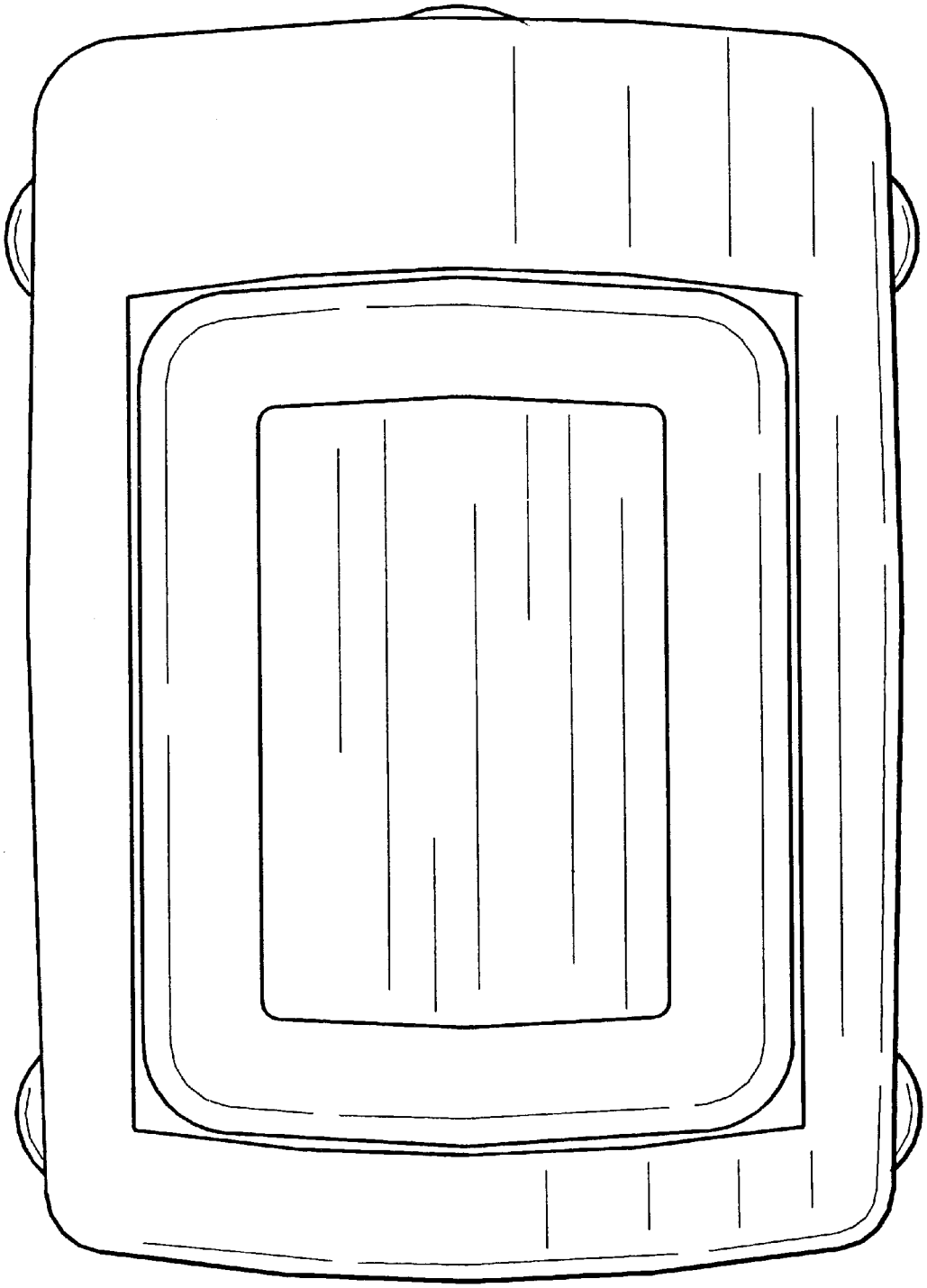
FIG. 32 is a bottom plan view of the fourth embodiment.

FIG. 24 illustrates a container 130 according to another preferred embodiment of the invention. Container 130 is shown in a vertical orientation with a spout 132 and cap 134 its top 136. Container 130 includes a stacking wall 138 which permits the container to be stacked in a horizontal orientation. That is, container 130 will be laid on its side in during shipping and warehouse storage. Stacking wall 138 is provided with protrusions 140 and depressions 142 which permit stacking of the containers in a brick-like fashion. It will be appreciated that a similar stacking wall is provided on the container opposite the illustrated one but is hidden from view in FIG. 24. The protrusions are received in the depressions and provide a horizontal stability to the stacked assembly. This embodiment incorporates a large recessed handle 144 which may or may not include a finger hole (not shown). In this embodiment, ribs are not provided owing to the shallow construction of the container when it is laid on its stacking wall 138 since only short side walls 146 are present, ribs or flutes are not needed to provide the required structural rigidity and stability. A pouring radius 148 is also provided near the bottom 150 of container. This construction is advantageous for containing and dispensing food products that are not liquid in form.

FIGS. 25–32 illustrate yet another preferred embodiment that is substantially identical to that described with reference to FIG. 24. Accordingly like numerals will refer to like elements and new numerals will identify new elements. The most noticeable addition are the structural load distributing features comprising a series of vertically spaced horizontal ribs or flutes 160 that transfer loads when the containers are stacked one on top of another. In this particular embodiment, the ribs are circumferentially continuous and generally equispaced along the container, although it will be appreciated that other arrangements may be used without departing from the scope and intent of the subject invention. Moreover, the curved wall 162 just beneath the spout is more apparent in this embodiment to facilitate receipt over the lip of a cup (not shown). The handle is again integrally formed with the remainder of the container and forms a finger receiving opening 164 in the container. Features such as the radius 148, the curved wall 162, and an enlarged spout that provides an anti-glug function as well as a no-drip function are desirable consumer oriented attributes.

Figure 33:
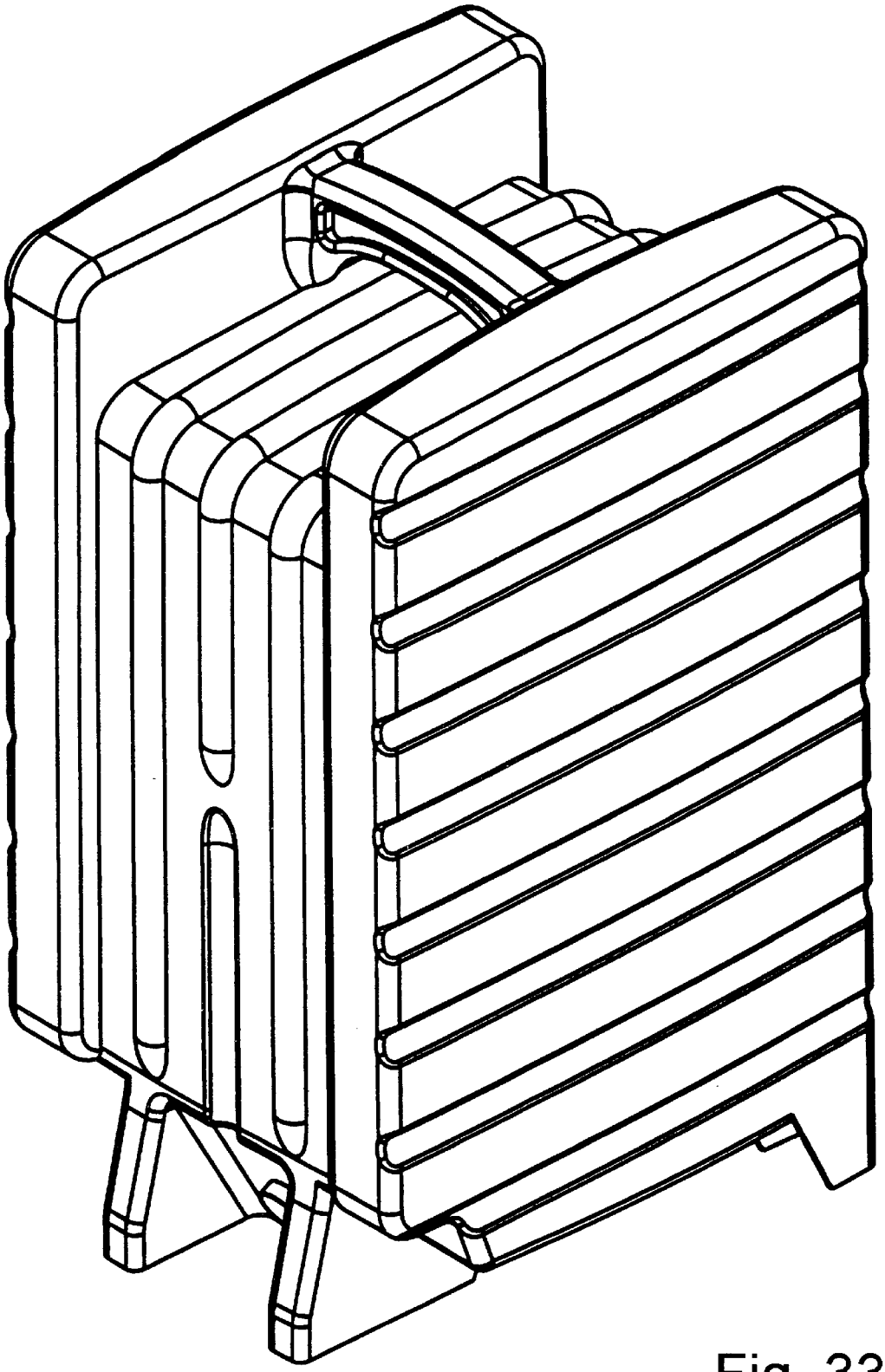
FIG. 33 is a perspective view taken generally from the top and front of a fifth preferred embodiment.
Figure 34:
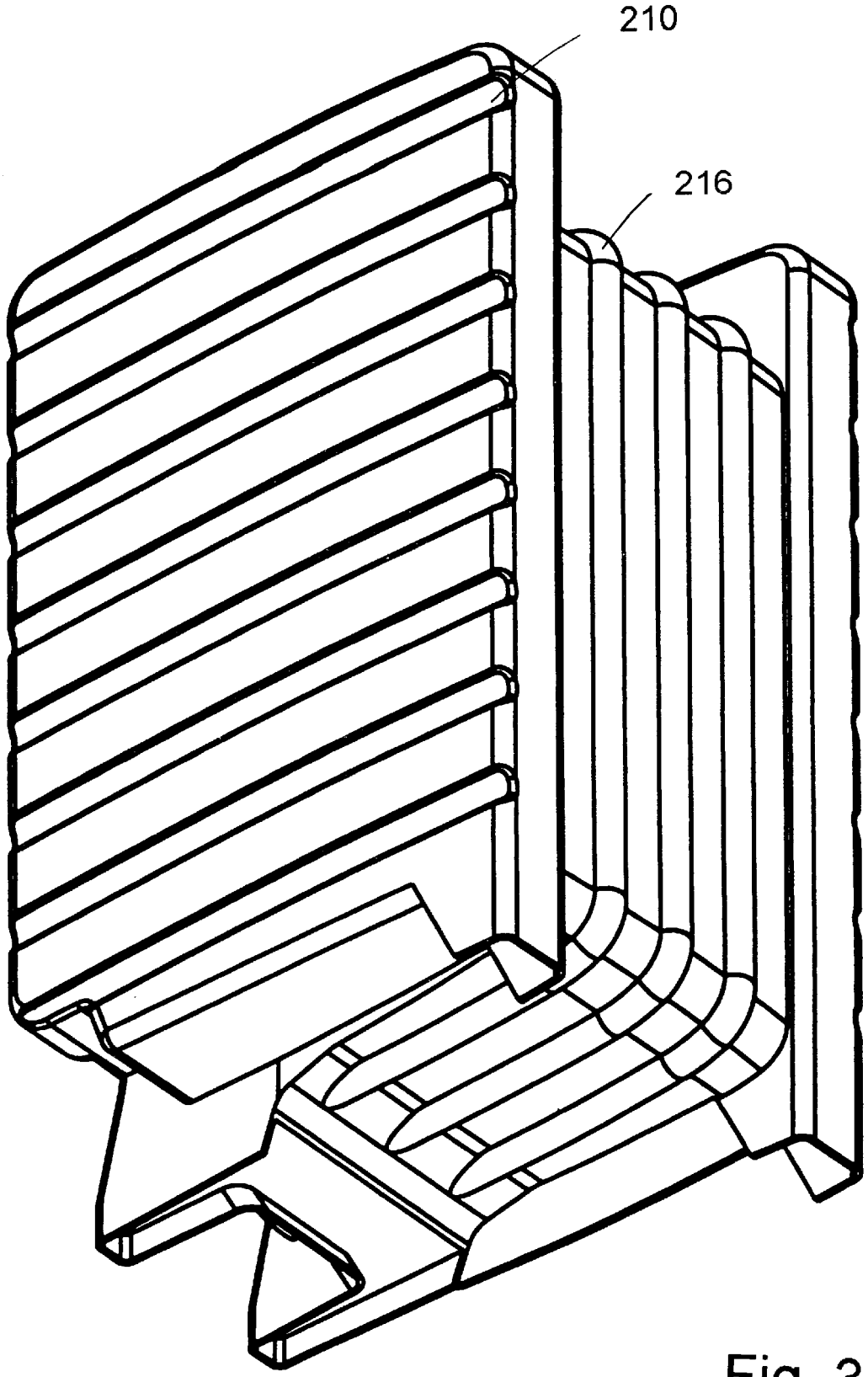
FIG. 34 is a perspective view of the fifth embodiment taken generally from the bottom and rear.
Figure 35A:
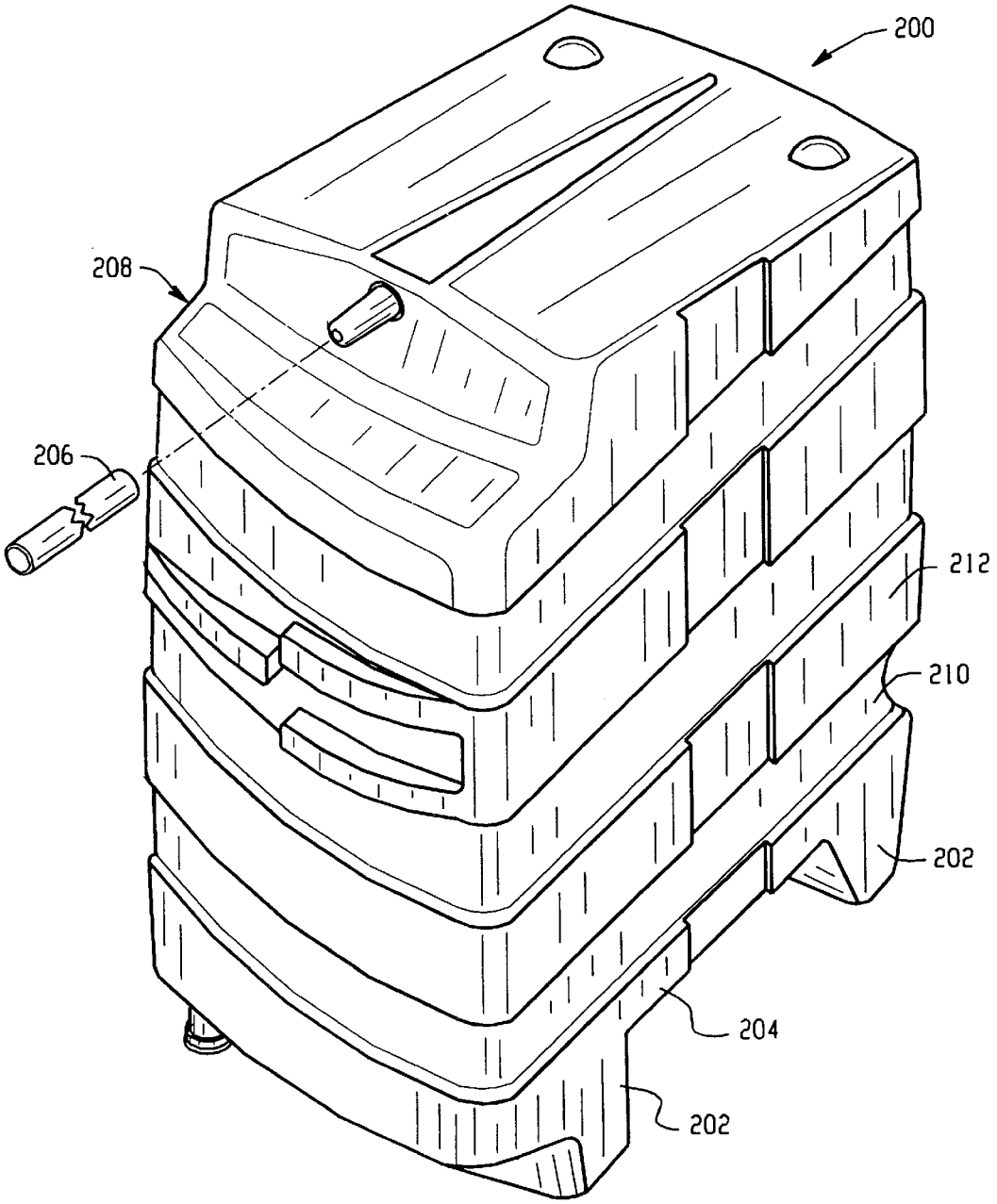
FIGS. 35A and 35B are a perspective view of a sixth embodiment similar to the fifth embodiment.
Figure 35B:
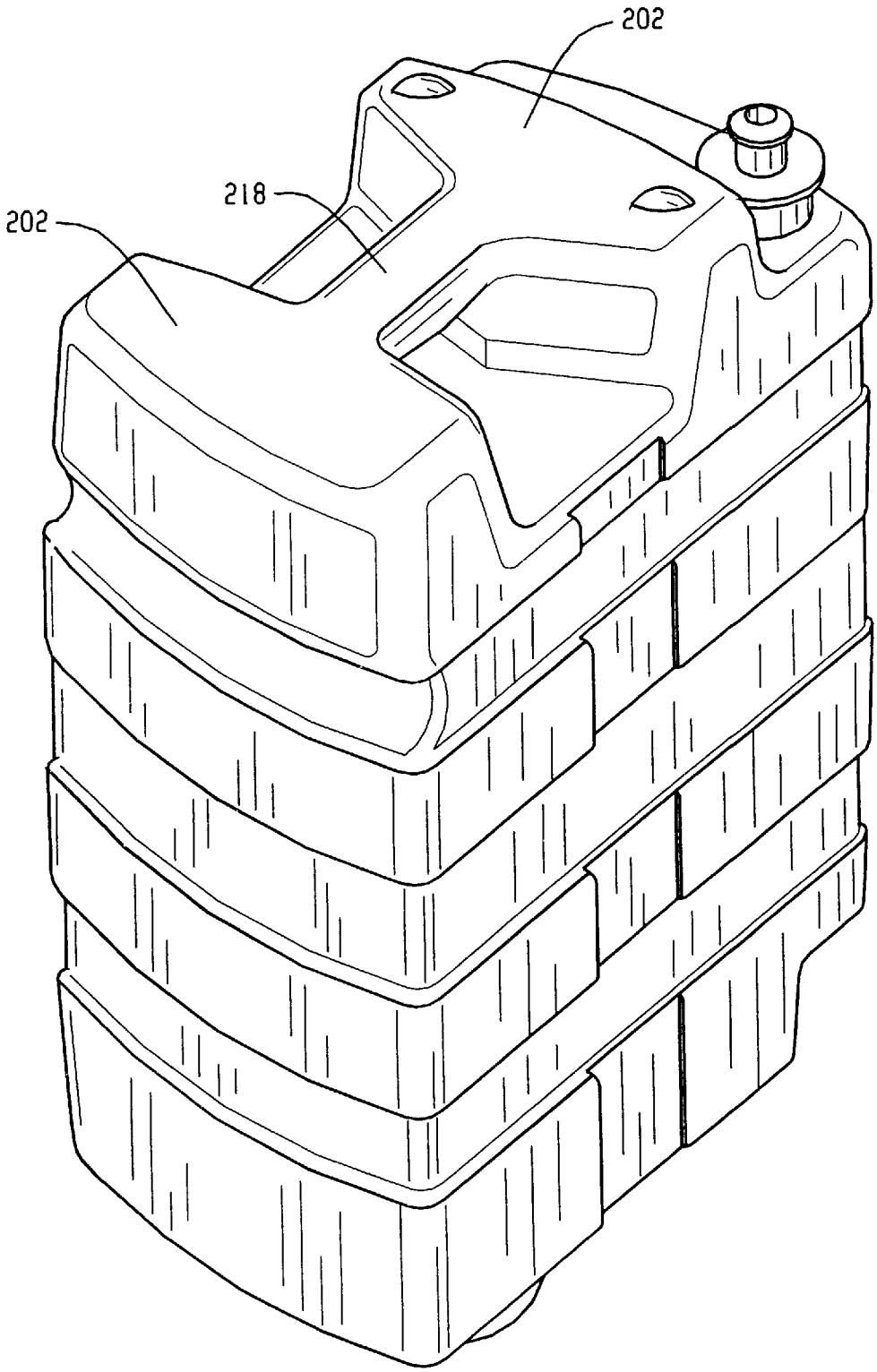
Figure 36:
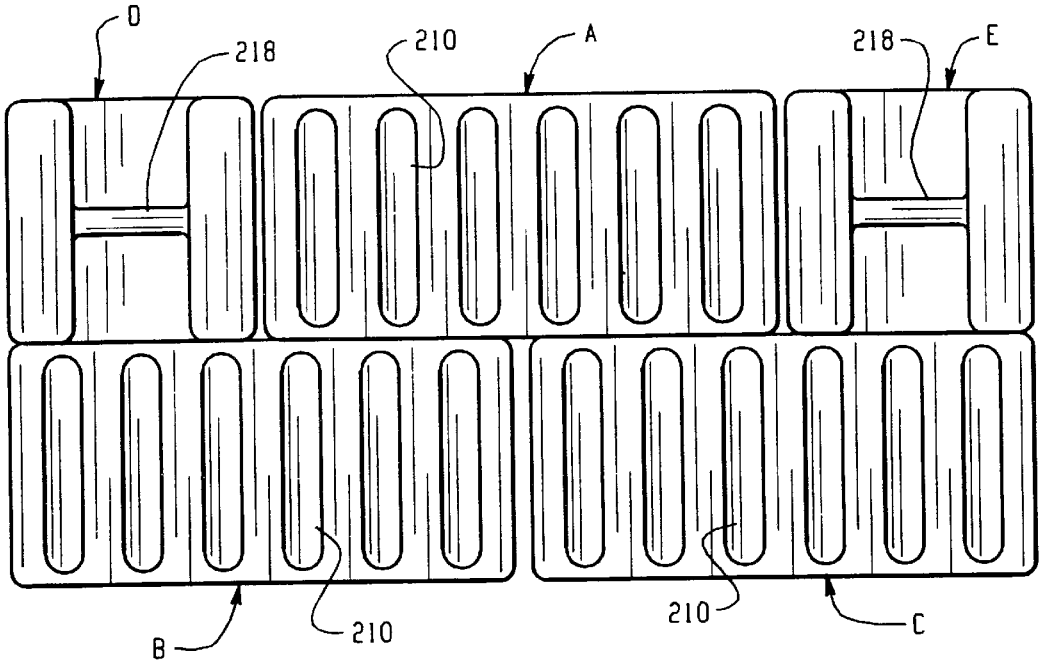
FIG. 36 is an elevational view of a stack of containers according to either the fourth or fifth embodiments.
Figure 37C:
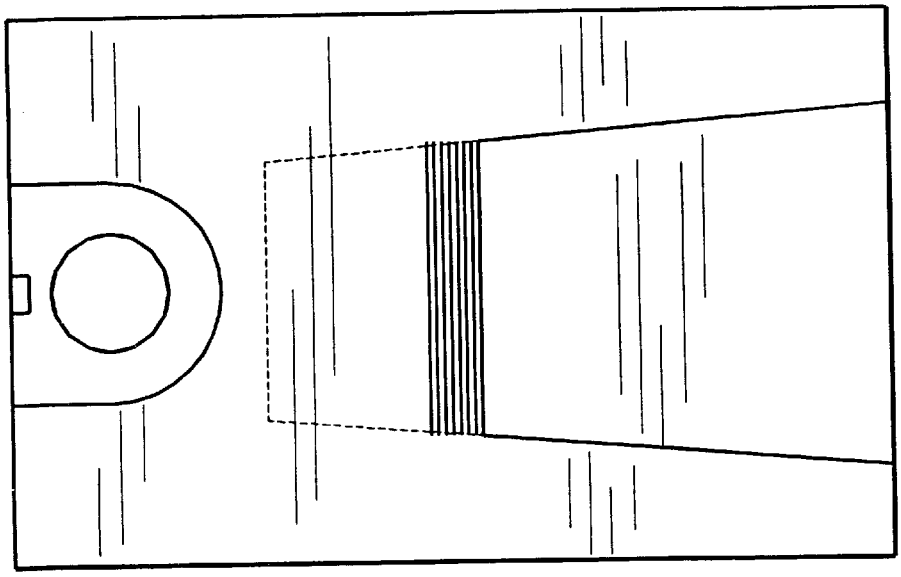
FIGS. 37A–F are elevational and plan views of a sixth preferred embodiment.
Figure 37A:
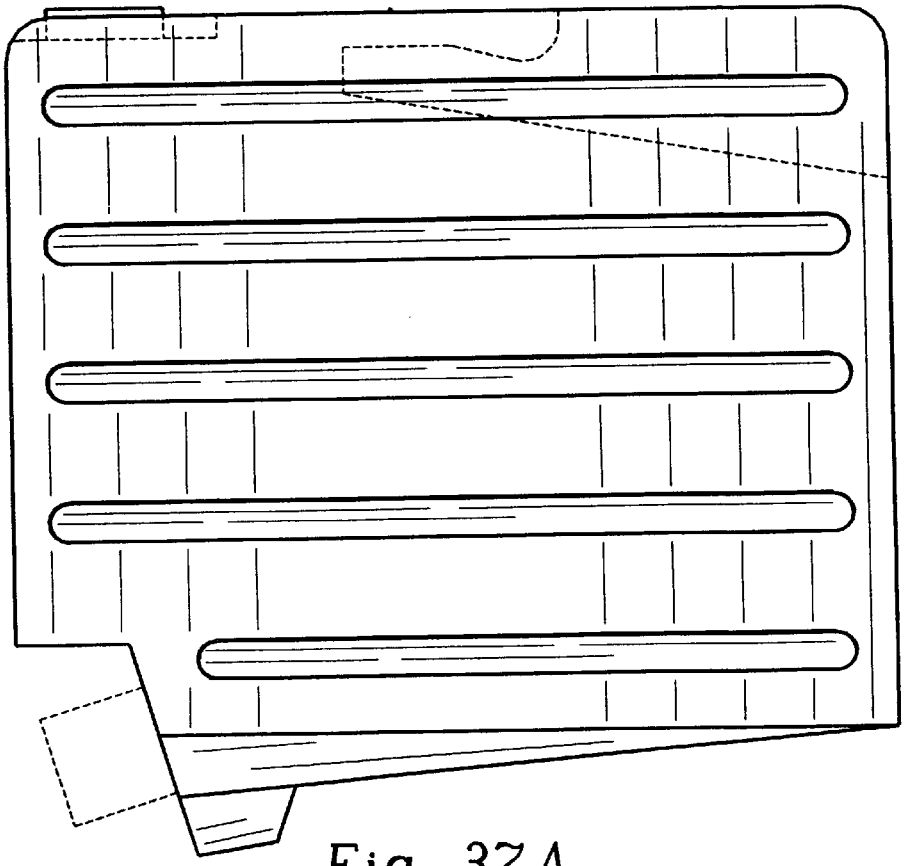
Figure 37D:
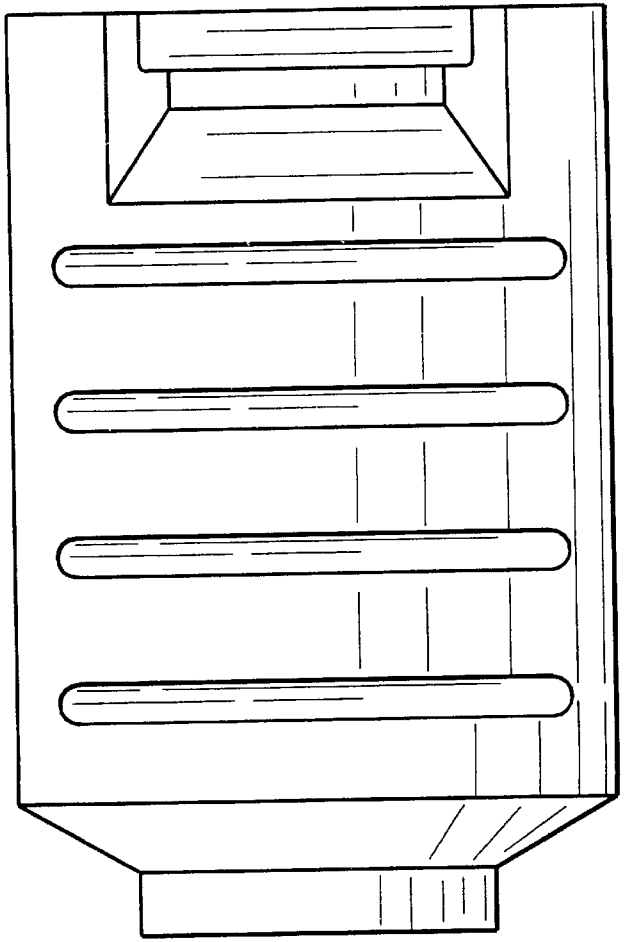
Figure 37B:
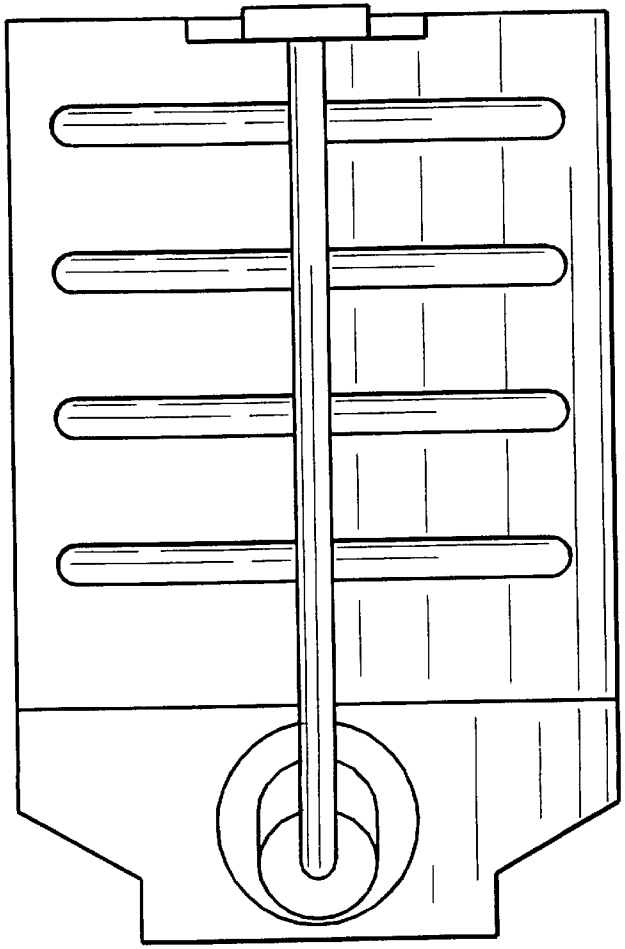
Figure 37F:
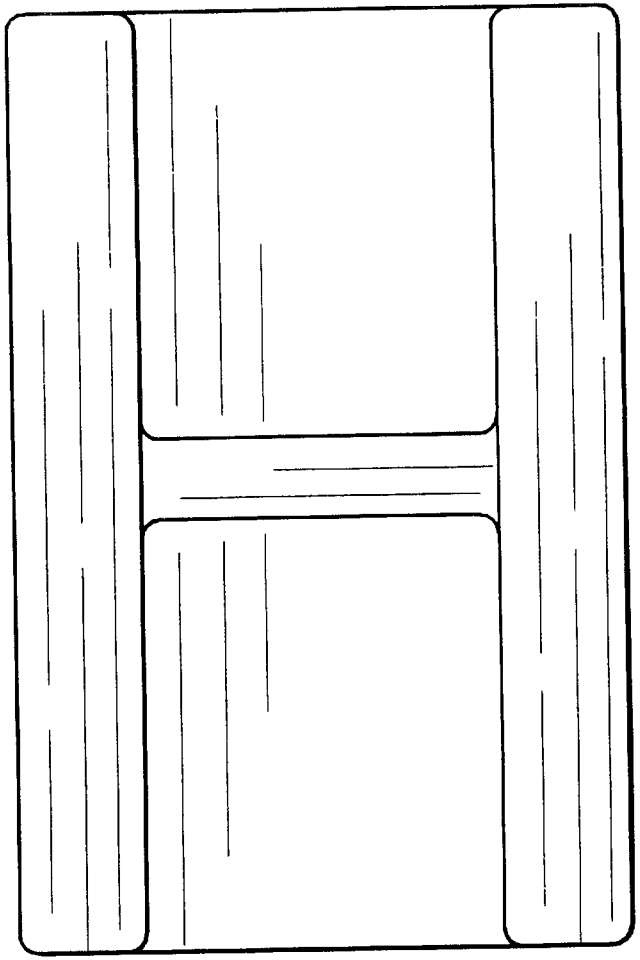
Figure 37E:
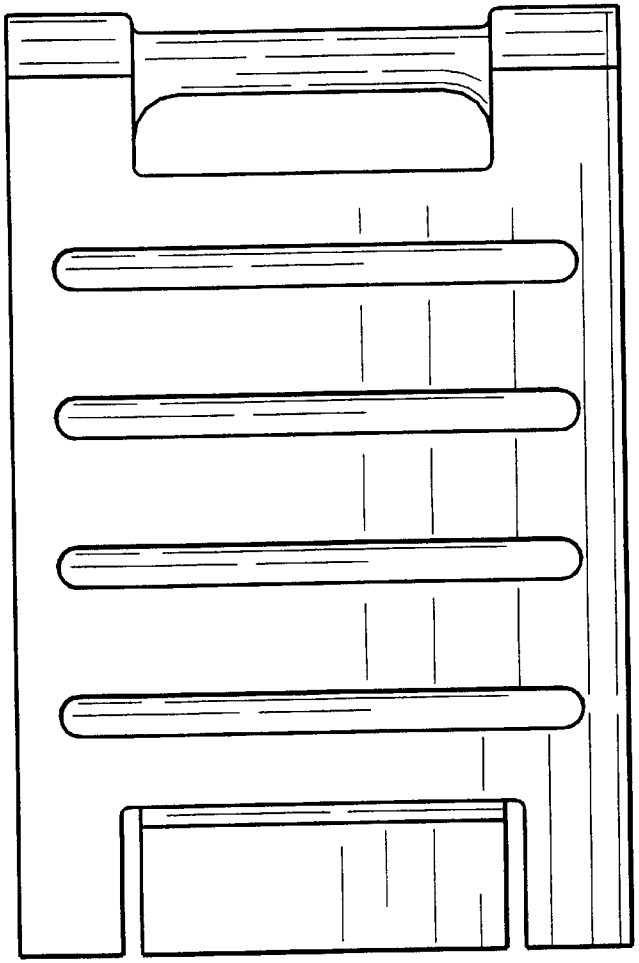

A fifth preferred embodiment is shown in FIGS. 33 and 34. Like the sixth embodiment of FIGS. 35A and 35B, and a related embodiment of FIGS. 37A–F, this container is intended to transport larger amounts of milk or fruit juice while taking advantages of the caseless container concept described above and hereafter. These embodiments utilize a container structure that is in the form of a rectangular prism, generally referenced by the numeral 200. The container is formed of two side portions 202, which are formed integrally with a center section 204. The side sections 202 and center section 204 comprise a fluid containing volume for containing liquid therein. Handle 218 is formed integrally connecting side sections 202. Center section 204 is formed with a recess 208 for housing a pivotable spigot or tube 206. The spigot is pivotably connected to the container in a known manner. Side walls 212 of the container are formed with a number of rib elements 210 for structural reinforcement thereof. The ribs 210 also improve the stacking characteristics of the container as will be explained below. In the embodiment of FIGS. 33 and 34, additional ribs 216 are provided along the center section and are oriented in the opposite direction from the ribs 210, i.e. in the vertical direction along the sidewalls and in a horizontal direction along the upper and lower walls. Moreover, FIGS. 35A and 35B demonstrates how the protrusion and depression feature may also be incorporated into the larger containers to aid in stacking in a brick-like fashion (FIG. 36). It will also be understood that a shrink wrap may be used with this embodiment for holding the spigot in place and for purposes of cleanliness.

FIG. 36 shows a stacking arrangement for these types of containers. The dimensions of the rectangular prism 200 are selected such that the height of the container is preferably twice the width and depth of the container. This construction lends itself to the stacking arrangement illustrated in FIG. 36. Containers A, B, and C in FIG. 36 are laid along their sides 210. Not shown in FIG. 36 are three (3) other containers which are beneath containers A, B, and C and also laid along their sides 210. Containers D and E are oriented such that they stand upright with handles 218 oriented on top of a container. The stacking concept illustrated in FIG. 36 thus permits a compact grouping unit of eight containers which may be held together using a flexible wrapping material such as a shrink wrap thermoplastic as was explained above. It will be recognized that handles 218 are oriented to permit easy carrying of the grouping unit illustrated in FIG. 36. It will also be recognized that those containers B and C, and the containers disposed beneath them (not shown), will be oriented such that their respective handles are displayed or oriented outward of the unit grouping and, thus, will provide additional handles for carrying or lifting the unit illustrated.

Figure 38:
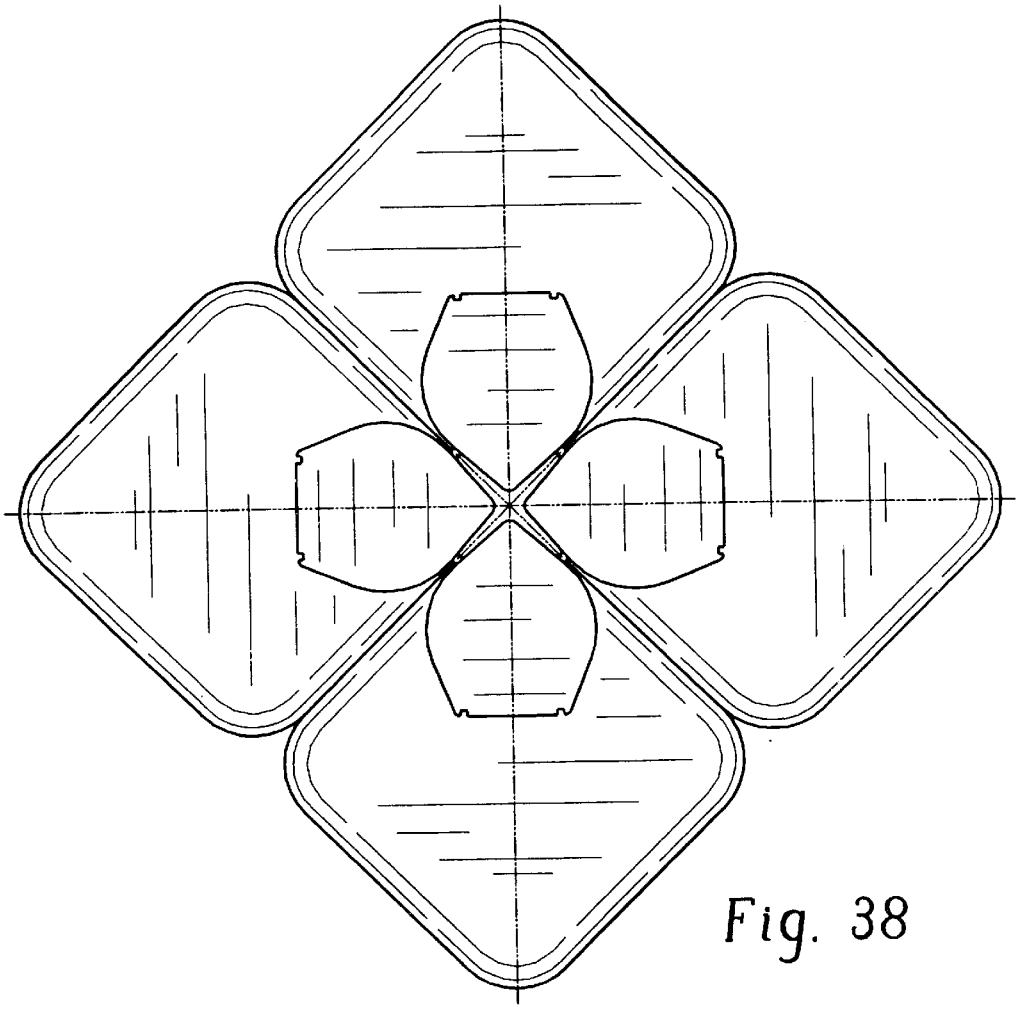
FIG. 38 is a top plan view of four containers disposed in abutting relation to form a first unit.

FIG. 38 is a plan view similar to FIG. 15 that illustrates how a group of containers can be grouped together in a unit and the handles advantageously situated to aid in lifting or transporting the containers as a unit. For example, as disclosed in FIG. 15 the first flexible wrapping material only extends about the lower portion of the abutting containers. This leaves access to the handles so that the containers can be easily manipulated as a unit. In FIG. 38, the handles will be located at each corner of the arrayed containers and the pouring spouts are grouped at the center of the unit. Of course, different numbers of containers and different orientations can be used for different purposes and without departing from the scope and intent of the invention.

Figure 1B:
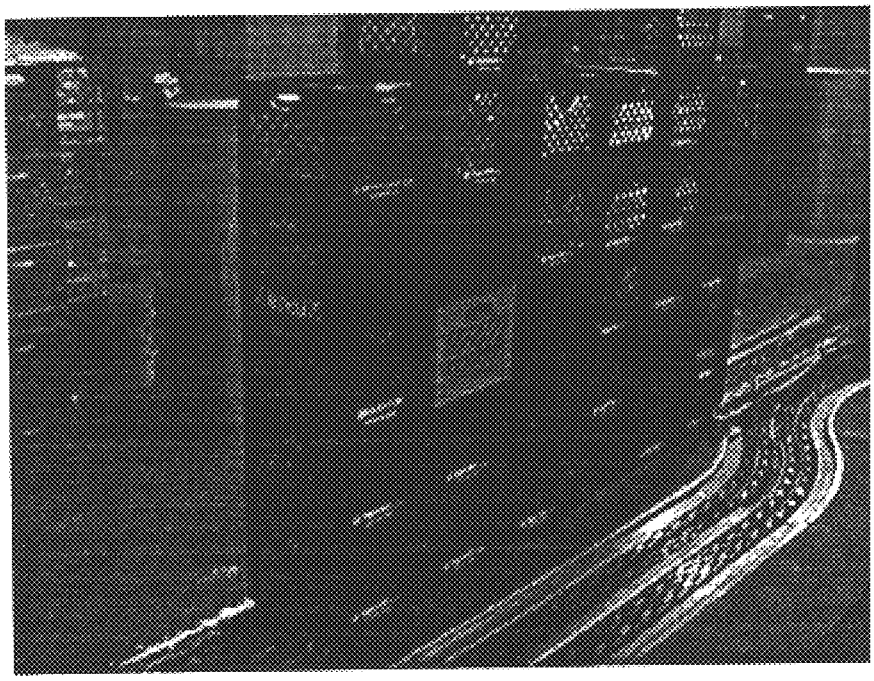
Figure 2A:
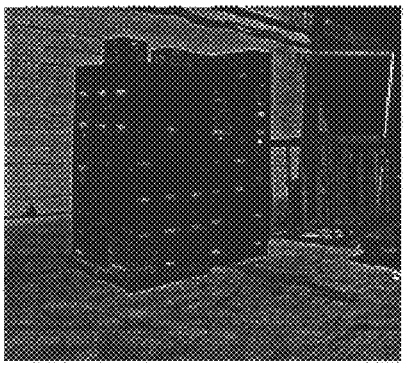
FIGS. 2A–2C illustrate delivery mechanisms for shipping large numbers of cases.
Figure 2C:
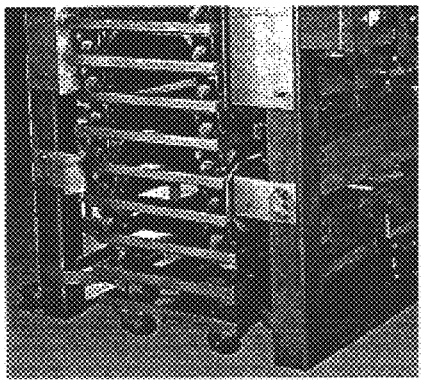
Figure 2B:
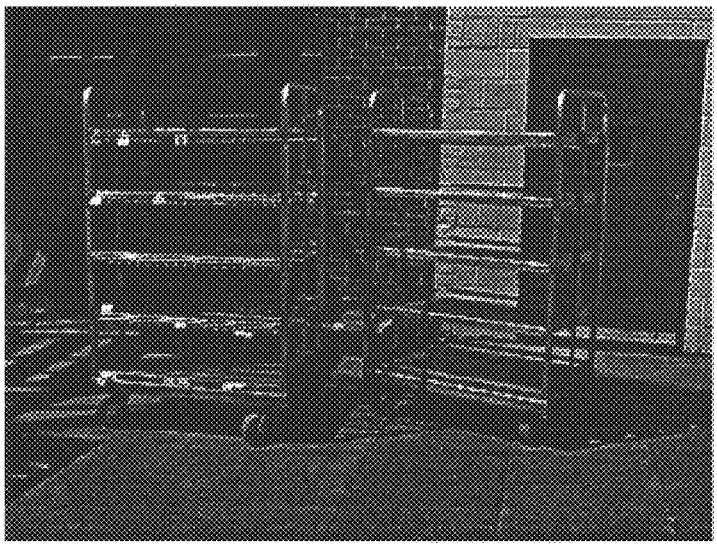
Figure 3:
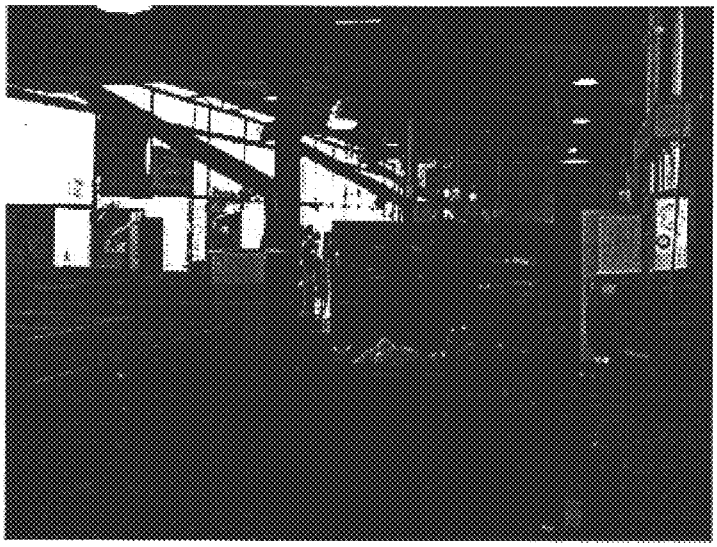
FIGS. 3 and 4 illustrate the space requirements associated with shipping via cases.
Figure 4:
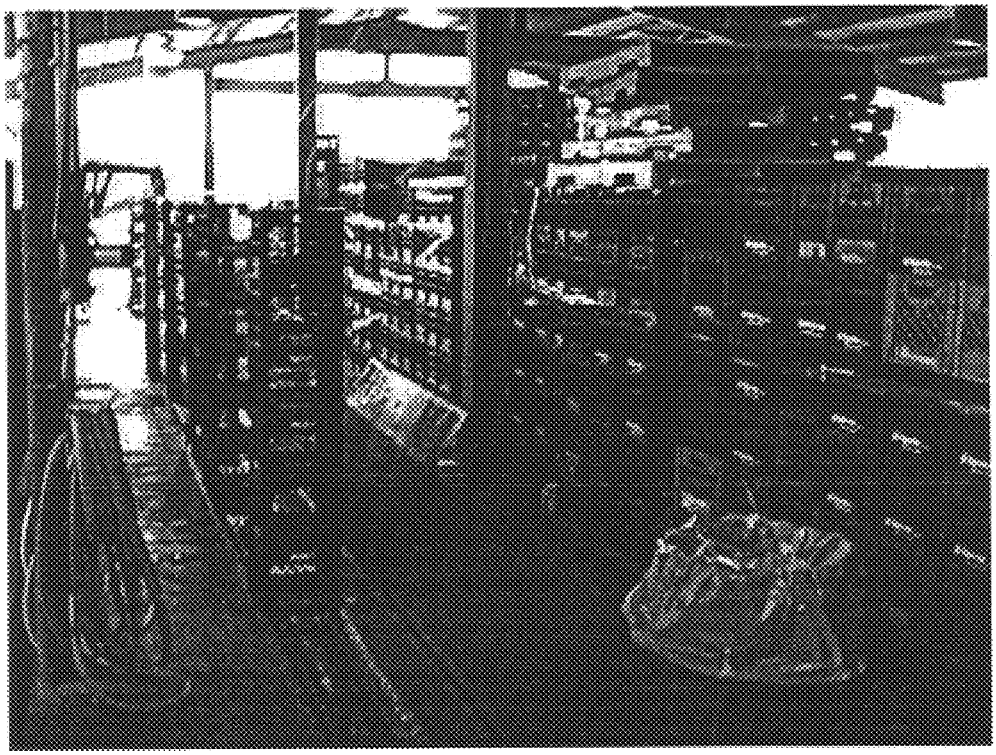
Figure 5A:
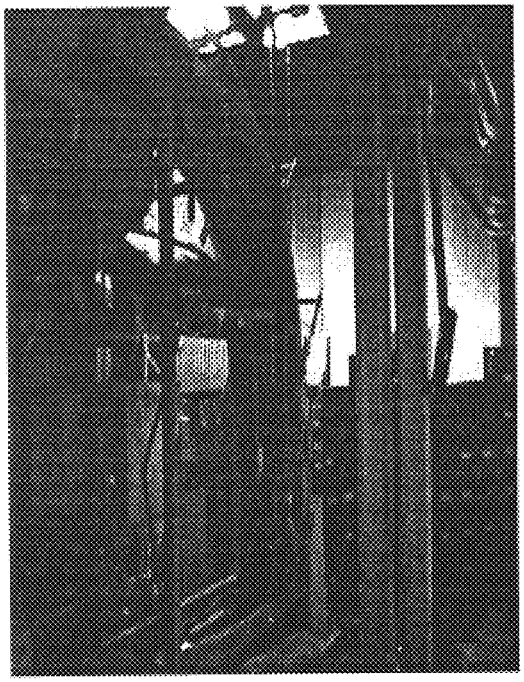
FIGS. 5A and 5B shows conventional destacking equipment for handling the cases.
Figure 5B:
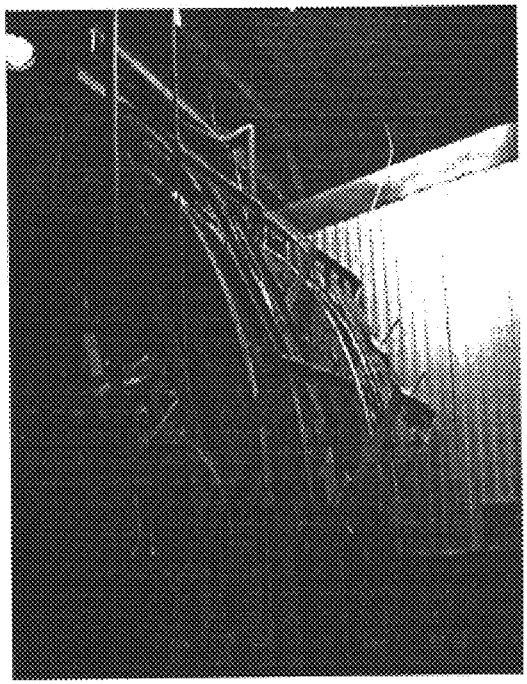
Figure 6:
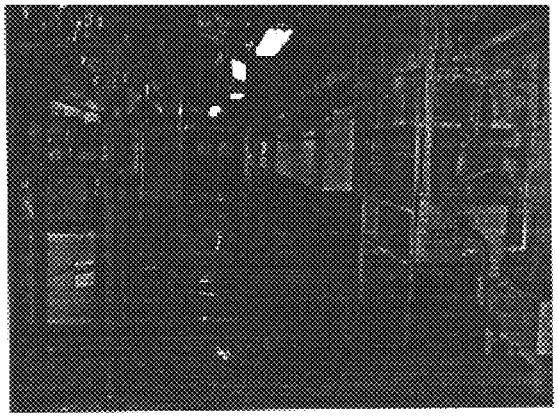
FIG. 6 represents typical case washing equipment associated with today's system.
Figure 7A:
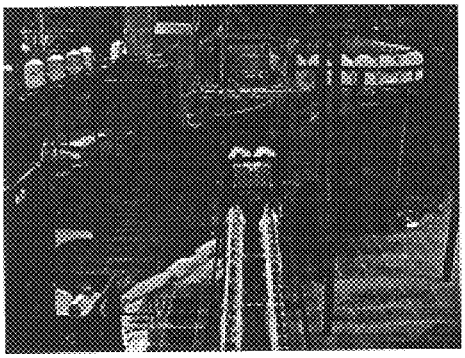
FIGS. 7A–7C illustrate the filling and storage process encountered in a dairy.
Figure 7B:
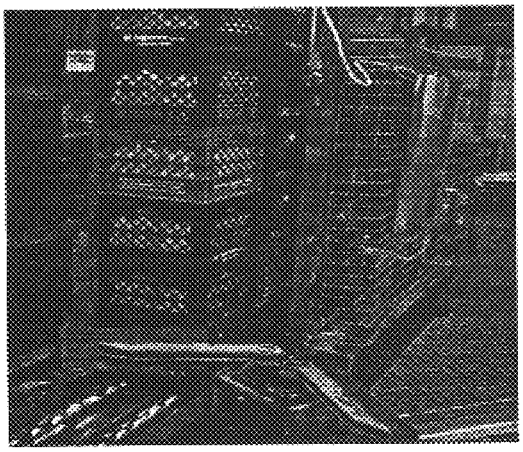
Figure 7C:
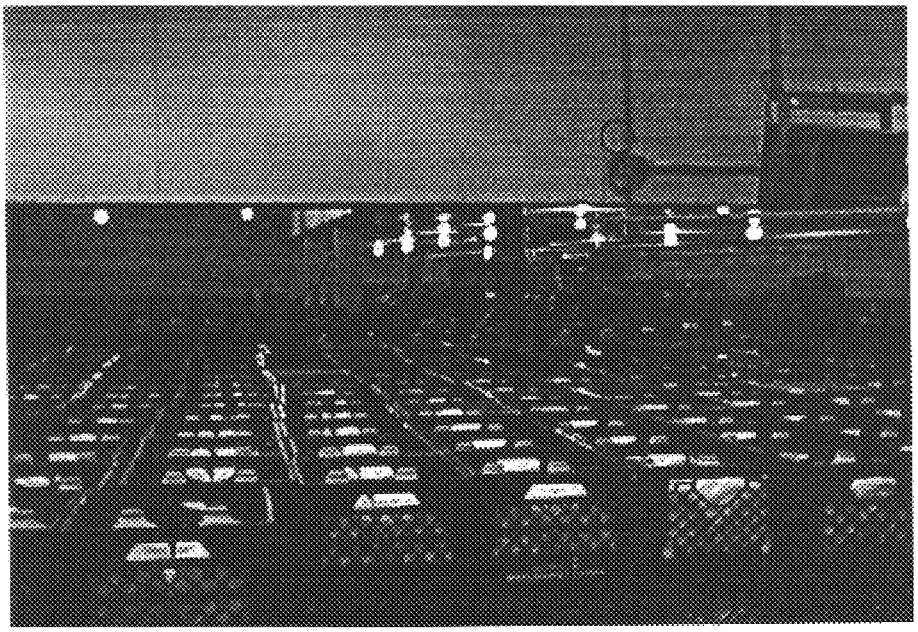
Figure 8A:
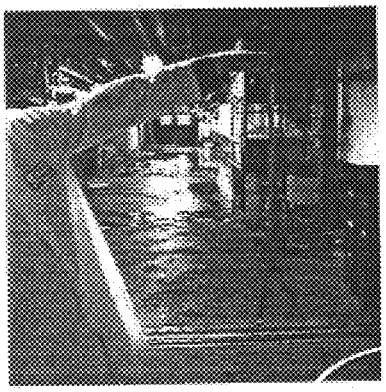
FIGS. 8A–8C show three versions of handling filled cases.
Figure 8B:
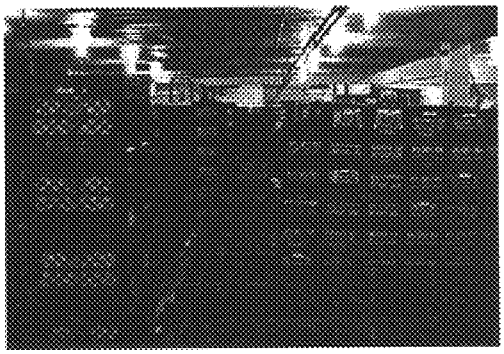
Figure 8C:
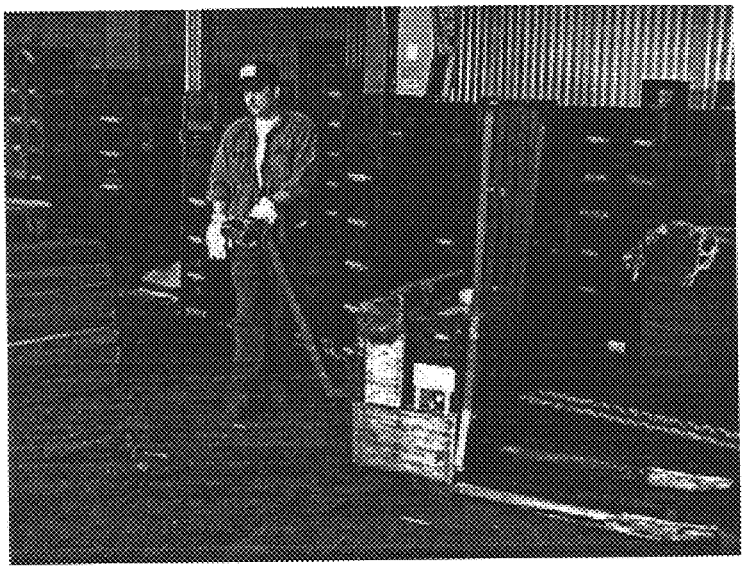
Figure 9:
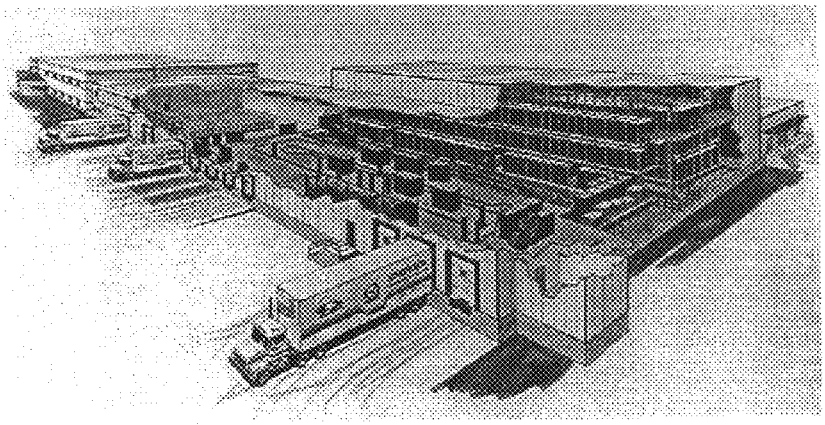
FIG. 9 is a representation of an automated material handling system.
Figure 10:
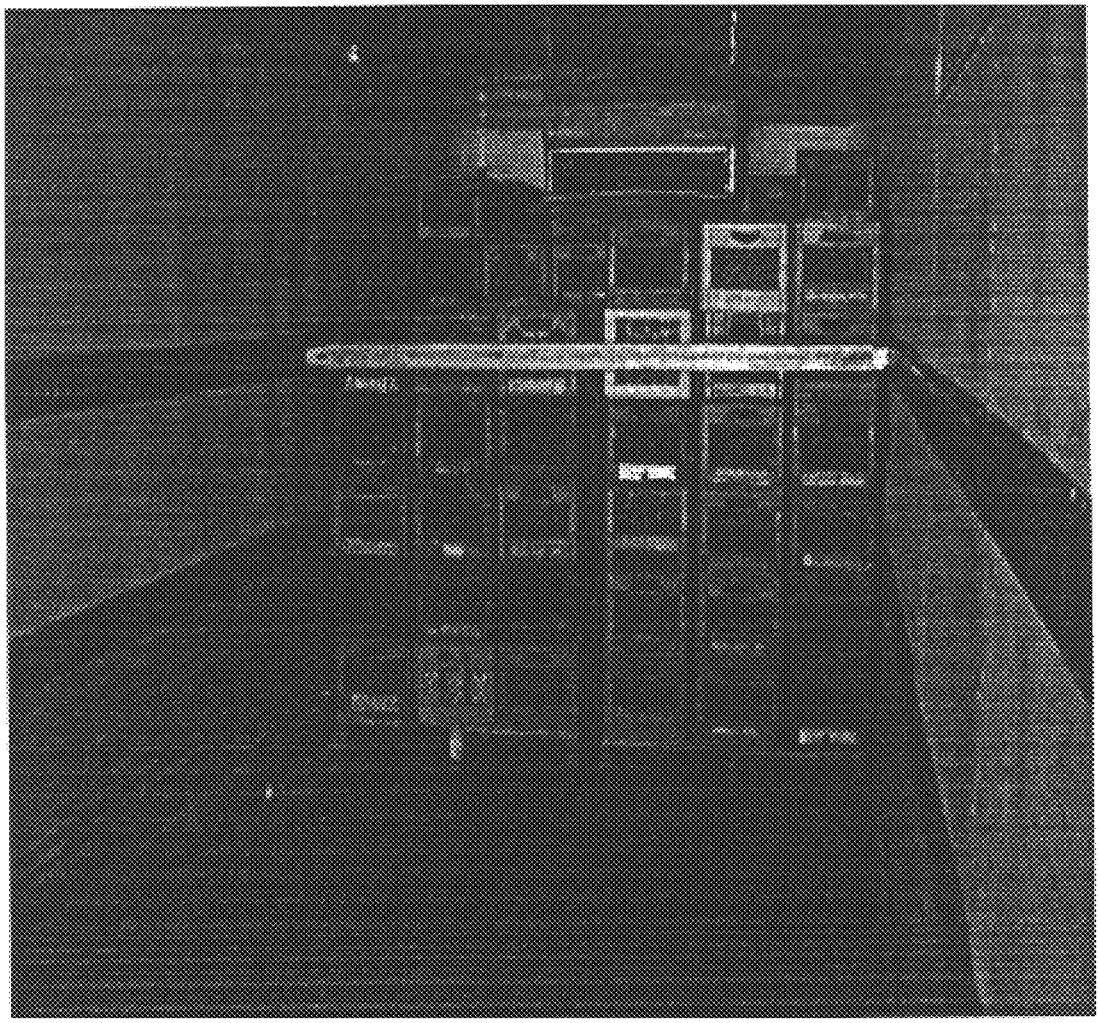
FIG. 10 illustrates a trailer loaded with empty cases.
Figure 11A:
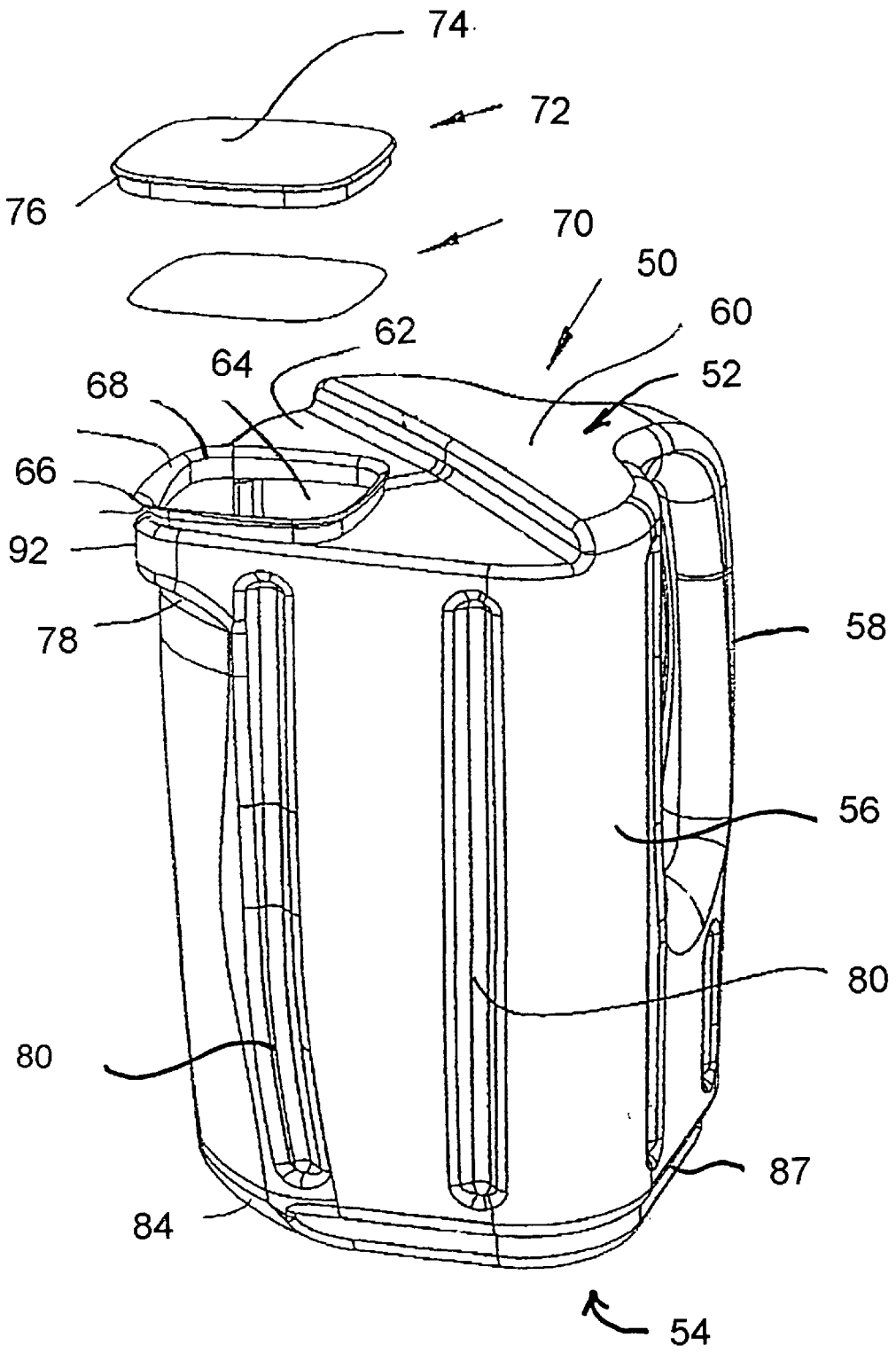
FIG. 11A is a perspective view of the first preferred embodiment and FIGS. 11B–11D are views of alternative sidewall configurations.
Figure 11B:
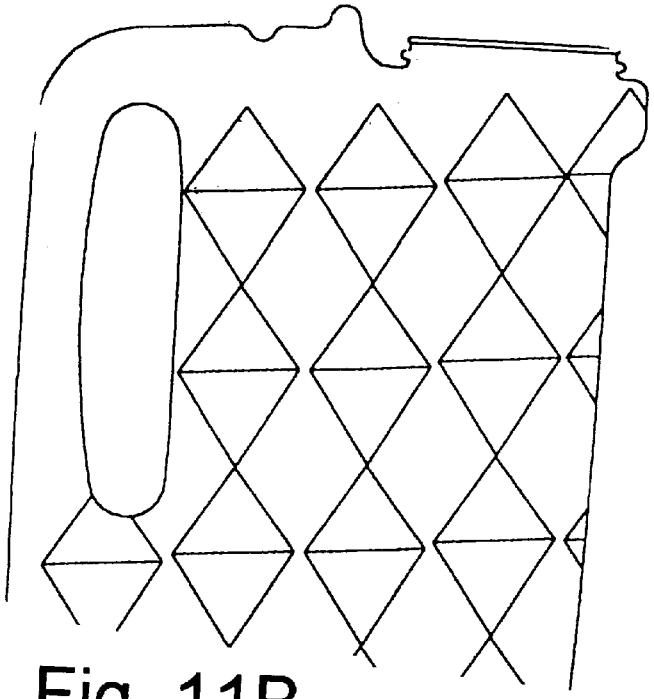
Figure 11C:
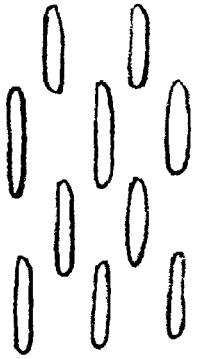
Figure 11D:
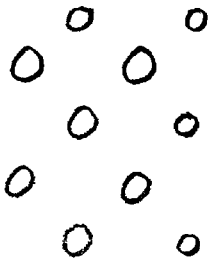
Figure 39:
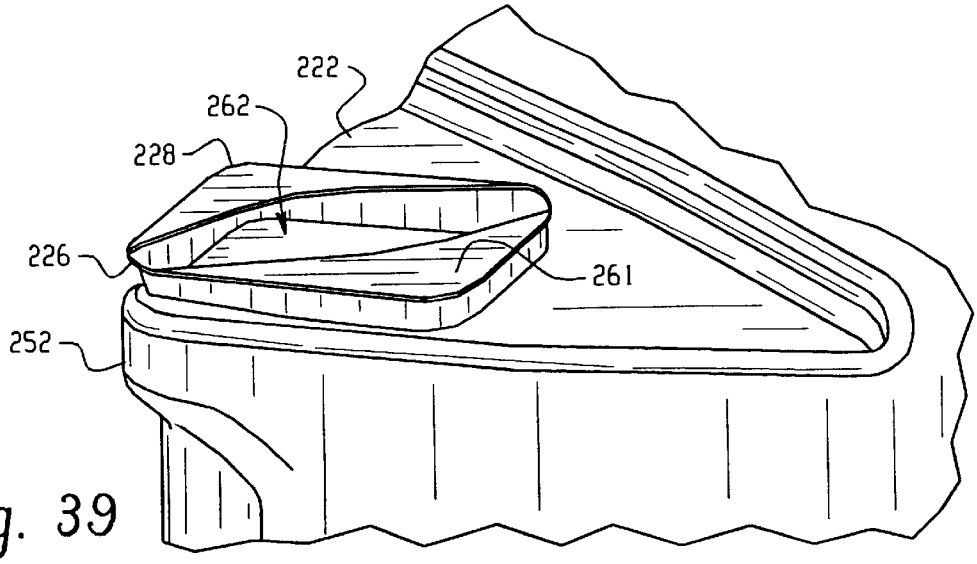
FIG. 39 is a perspective of a pouring spout according to a preferred embodiment of the invention.

FIG. 39 illustrates a pouring spout according to another preferred embodiment of the present invention. Like the embodiment shown in FIG. 1, this embodiment incorporates a deck portion 222 on which is located a pouring lip 226 extending upward therefrom. Lip 226 forms a pouring spout 228. In this embodiment, a pouring guard 260 is provided on the pouring spout. Guard 226 is provided with a narrow diamond-shaped aperture 262 which permits egress of the liquid or other material contained in the container. Guard 260 provides for a more narrow stream of liquid than would be provided by pouring spout 228 alone.

Figure 40F:
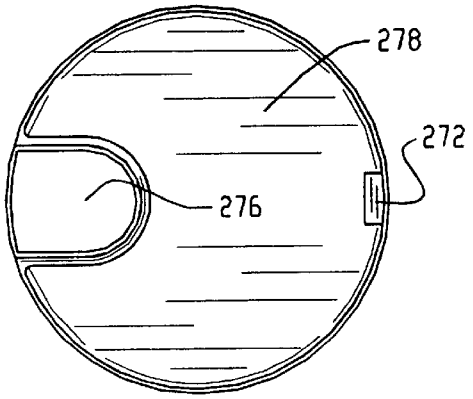
FIGS. 40A–F are perspective and plan views of various insertable spouts configurations.
Figure 40E:
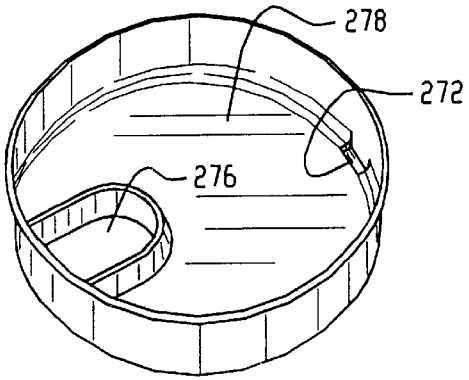
Figure 40D:
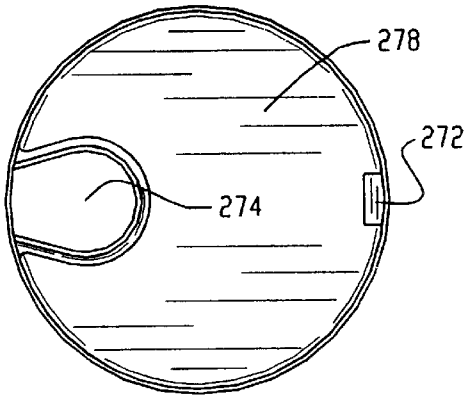
Figure 40C:
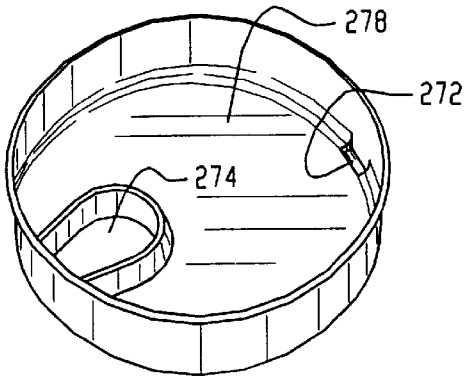
Figure 40B:
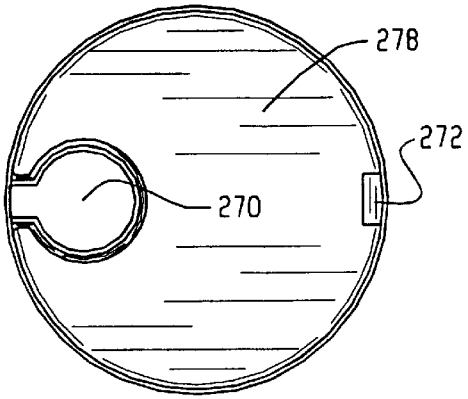
Figure 40A:
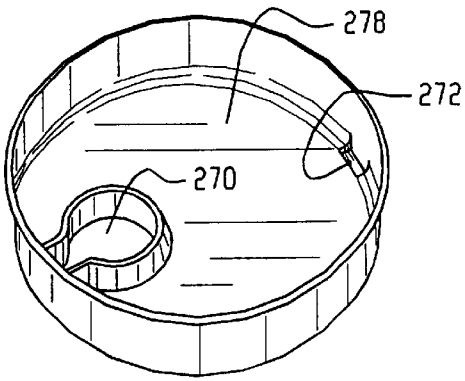

FIGS. 40A–F illustrate a variety of removable pouring inserts that may be incorporated into the pour spout. FIGS. 40A and 40B show a key-shaped opening 270 and a vent or anti-glug opening 272 diametrically opposite therefrom. A droplet-shaped opening 274 is embodied in FIGS. 40C and 40D while a generally U-shaped opening 276 is incorporated into the embodiment of FIGS. 40E and 40F. In each, the generally planar surface 278 has a taper that allows any liquid that is spilled over the edge of the pour opening to drain into the vent opening when the container is oriented in its upright, vertical position. The removable nature of the pouring inserts allows the consumer to remove the insert and refill the container, if desired.

Figure 41A:
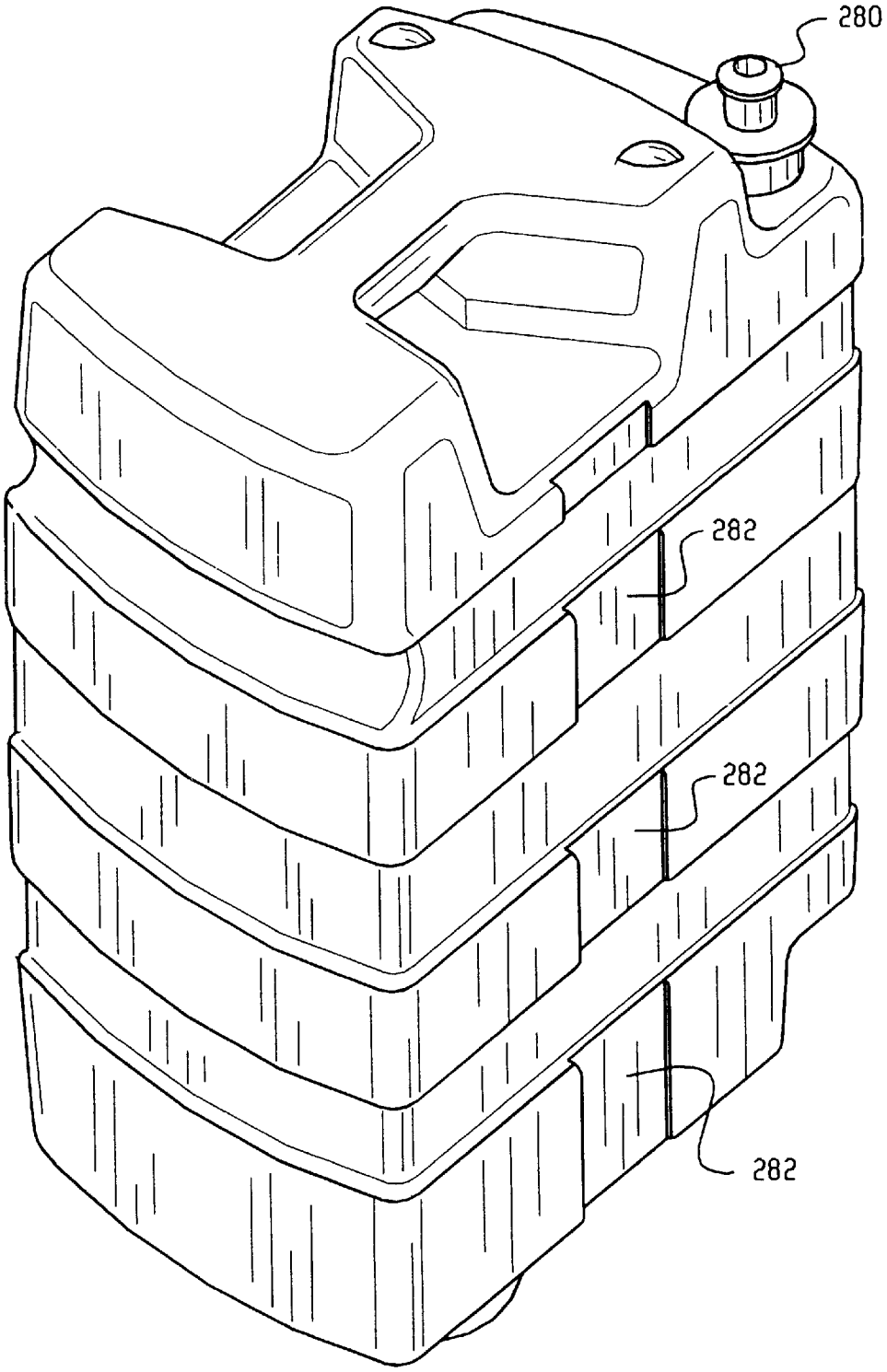
FIGS. 41A and 41B are perspective views from the top, rear and the bottom, front regions of the container, respectively.
Figure 41B:
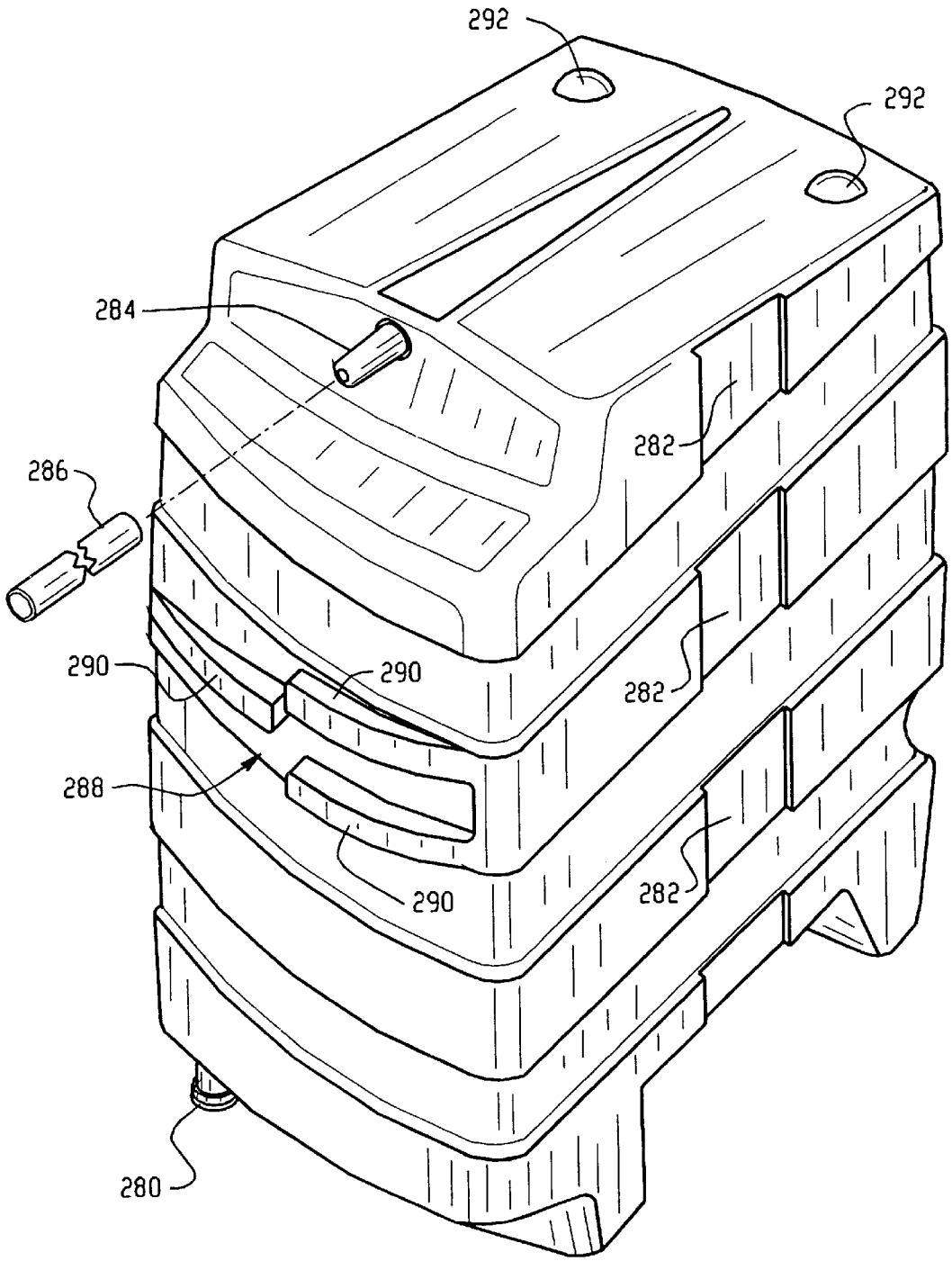

FIGS. 41A and 41B illustrate yet a further embodiment which finds application in larger containers such as two and one-half, three, and five gallon sizes. It includes a vent cap 280 located adjacent the top surface and ribs 282 in the sidewall for load transfer to the bottom surface. As best illustrated in FIG. 41B, a dispensing nozzle 284 receives one end of a dispensing tube 286 and the other end of the tube is frictionally engaged by a tube holddown 288 defined by offset flanges 290 that extend from the front wall of the container. The bottom surface also preferably includes a slight taper from the domed feet 292 toward the dispensing nozzle to aid in dispensing product from the container.

A differently configured container having a large, wide top and bottom surface to distribute the stacking load along the structurally desirable locations such as the cap and handle may be developed using the features and attributes of the invention. Structural ribs that run perpendicular to the parting line can be placed at critical locations along the horizontal, top surface to resist vertical, plastic deformation and bending. The vent tube, cap and large, structural handle were designed to handle the load in parallel to the parting line. The top and bottom surfaces have been designed to nest in a manner to allow stress from static and dynamic loads to be distributed to the sidewalls.

Vertical surfaces are provided with molded, structural ribs to provide an increased section modulus along the member and provide improved resistance to bending moments, deflections and buckling than is available in the presently used milk container. The ribs also act as columns to distribute loads from the top of the container to the bottom of the container. The ribs may be molded to have a "V" or fluted shaped cross-section to permit the use of molds without undercuts therein. Structural tests conclude that the stress is transmitted through the footprint of the above case through the desired crown and down the sides of the container.

A structural label may also be used to add strength to the container. The structure may operate as a pressure vessel and/or a static structure to support loads typically experienced during shipping and distribution. Cap and foil seals may be in incorporated to resist leakage and maintain internal pressures. The containers will be shrink-wrapped in cases of four, six, or other appropriate number, for example, which provides structural support and a unitized method for handling groups of containers through a distribution network. Thereafter, the units are arrayed and stacked into larger handling groups such as on a pallet and wrapped by a second flexible member, e.g. another plastic wrapping material, to form a larger shipping or transport group that can be handled in the same general manner as stacks of cases. The containers can be stacked five or six high—just as the cases are presently stacked—because of the ability to transfer loads effectively thorough the container without cases. The overall cost of manufacturing, cleaning, handling, storage, etc. of cases as described above is eliminated.

Structural tests indicate that the shrink-wrapped cases have a decrease in the column deflections by a factor of three. The containers were dynamically tested on a vibratory table to stimulate the dynamic situation which occurs during handling and truck transport. Pallets are usually handled with motorized fork trucks which load the trucks. Vibration testing was conducted on fork truck and trucks in transport. These results were utilized in the dynamic laboratory testing. It was observed that the columnar effect that is developed in the pallet configuration allow the degrees of freedom similar to a building during an earthquake. These degrees of freedom allow the pallet to act as a unit; yet flex and move under loading to prevent detrimental stress concentrations which can negatively impact the structural integrity of the cases and containers.

A diamond shaped pouring spout may be included and is of a large enough dimension to permit venting back into the container to prevent "glugging" and to prevent dripping. A front surface of the container may be formed to include a large radius aligned with the spout to permit a rocking action which allows the container to be tilted easily without lifting from the support surface. The spout may be formed with a recess thereunder for placing a glass or cup and to minimize spills.

The group of stacked containers is then broken down into the individual units by removing the second wrapping material. To aid in its removal, the second flexible material may incorporate a tear strip or the like into the material to allow easy removal of the plastic wrapping.

The invention has been described with reference to the preferred embodiments. Obviously, modifications and alterations will be apparent to those of ordinary skill upon a reading and understanding of the specification. For example, the preferred material of construction is a food grade plastic such as a high density polyethylene (HDPE) although alternative materials that comprise a plastic, at least in part, could be used. The invention is intended to include all such modifications and alterations.

What is claimed is:

1. A molded plastic container used in caseless shipping of a product, such as milk or juice, the plastic container comprising:

a base having a substantially planar region;

a top surface having a substantially planar load bearing region parallel to the substantially planar region of the base;

a sidewall integrally formed with and extending between the base and top surface generally parallel to a longitudinal axis of the container, the sidewall enclosing an internal cavity;

a pour spout disposed in the top surface offset from the longitudinal axis of the container;

a handle extending from the sidewall and defining a finger receiving region, the handle interposed between the base and top surface and integrally formed with the base, top surface, and sidewall; and a structural load distributing feature formed therein for conveying bearing loads from the top surface to the base.

2. The container of claim 1 wherein the structural load distributing feature includes at least one rib formed in the sidewall and extending between the top surface and the base.

3. The container of claim 2 wherein the structural load distributing feature extends in a continuous fashion along the planar region of the top surface and the sidewall.

4. The container of claim 3 wherein the structural load distributing feature is disposed between the pour spout and the handle.

5. The container of claim 1 wherein the sidewall includes a series of sidewalls and selected ones of the sidewalls include substantially planar regions for abutting against substantially planar regions of sidewalls of like containers.

6. The container of claim 1 further comprising a rounded region along an edge portion of the base beneath the pour spout to facilitate pouring.

7. The container of claim 1 further comprising a structural load distributing feature formed therein for conveying bearing loads from the top surface to the base, the handle extending downwardly from the top surface toward the base and the structural load distributing feature substantially aligned with the handle for transferring loads from the handle to the base.

8. The container of claim 1 further comprising a resealable lid operatively associated with the pour spout.

9. The container of claim 1 wherein the container is a thin-walled material.

10. The container of claim 9 wherein the container has a weight to volume ratio of approximately 55 to 70 grams per gallon (approximately 18 to 24 grams per liter).

11. The container of claim 1 wherein the pour spout includes an air opening disposed in spaced relation to a pour opening.

12. The container of claim 1 wherein the center of gravity of the container is disposed closer to the pour spout than to the handle to facilitate pouring of liquid from the container.

13. The container of claim 1 wherein the pour spout is disposed opposite the handle adjacent an edge of the container.

14. A blow-molded plastic dairy container comprising:

a base having a substantially planar load bearing region;

a top surface having a substantially planar load bearing region parallel to the substantially planar region of the base and having a pour spout spaced from the substantially planar region of the top surface and disposed adjacent an edge of the top surface;

a sidewall extending between the base and top surface, the sidewall enclosing an internal cavity in fluid communication with the pour spout;

a handle interposed between the base and top surface; and a structural load distributing feature formed in at least the sidewall for conveying bearing loads from the top surface to the base.

15. The container of claim 14 wherein the sidewall defines a polygon in cross-section that encloses the internal cavity.

16. The container of claim 14 wherein the handle is disposed at a juncture of contiguous sidewall portions and has a finger receiving region.

17. The container of claim 14 wherein the handle is integrally formed with the base, top surface, and sidewalls.

18. The container of claim 14 wherein the structural load distributing feature is integrally formed in at least the sidewall.

19. The container of claim 14 wherein the structural load distributing feature extends into the substantially planar load bearing region in the top surface.

20. The container of claim 14 wherein the structural load distributing feature includes a component that increases the sectional modulus of the sidewall.

21. The container of claim 20, wherein the structural load distributing feature is disposed in the sidewall beneath the pour spout.

22. The container of claim 20 wherein the structural load distributing feature is a rib.

23. The container of claim 20 wherein the structural load distributing feature is a series of offset ribs.

24. The container of claim 20 wherein the structural load distributing feature is a series of dimples.

25. The container of claim 20 wherein the structural load distributing feature is a series of diagonal reinforcements.

26. The container of claim 14 wherein the container has a weight to volume ratio of approximately fifty five (55) to seventy (70) grams per gallon (approximately eighteen to twenty-four (18–24) grams per liter).

27. A molded plastic comestible fluid container designed for stacking one filled container on top of another filled container and transferring both hydrostatic forces to prevent bulging and vertical forces to prevent buckling/crimping, the container comprising:

a base having a substantially planar load bearing region;

a top surface having a substantially planar load bearing region parallel to the substantially planar region of the base and having a pour spout disposed adjacent an edge of the top surface;

a sidewall extending between the base and top surface, the sidewall enclosing an internal cavity in fluid communication with the pour spout;

a handle interposed between the base and top surface; and a structural load distributing feature formed in at least the sidewall for conveying bearing loads from an adjacent container stacked on the top surface to the base.

28. The container of claim 27 wherein the pour spout is spaced from the substantially planar region of the top surface.

* * * * *